US006247784B1

(12) United States Patent
Obana et al.

(10) Patent No.: US 6,247,784 B1
(45) **Date of Patent: *Jun. 19, 2001**

(54) INK JET CARTRIDGE REPLACEMENT CONTROL

(75) Inventors: Katsumi Obana, Funabashi; Atsushi Saito; Keizo Sasai, both of Yokohama; Masanori Momose, Tokyo; Hiroshi Ogushi, Shiroi-machi; Takeshi Kohno, Kawasaki; Fumihiko Nakamura, Tokyo; Shinichiro Kohri, Kawasaki; Naomi Nakamura, Kawaguchi; Takayuki Nishinohara; Yasushi Morimoto, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/709,450

(22) Filed: Sep. 6, 1996

(30) Foreign Application Priority Data

Sep. 8, 1995 (JP) ..... 7-231275
Mar. 6, 1996 (JP) ..... 8-049239

(51) Int. Cl.[7] ..... B41J 23/00
(52) U.S. Cl. ..... 347/37; 347/7
(58) Field of Search ..... 347/37, 201, 86, 347/87, 44, 19, 18, 23, 49, 347

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 5,398,054 | * | 3/1995 | Fukazawa et al. | 347/33 |
| 5,512,926 | * | 4/1996 | Uchikata et al. | 347/86 |
| 5,579,039 | * | 11/1996 | Kurata et al. | 347/49 |
| 5,585,825 | * | 12/1996 | Kneezel et al | 347/14 |
| 5,828,389 | * | 10/1998 | Yamaguchi et al. | 347/23 |

FOREIGN PATENT DOCUMENTS

| | | | | |
|---|---|---|---|---|
| 54-056847 | | 5/1979 | (JP) . | |
| 59-123670 | | 7/1984 | (JP) . | |
| 59-138461 | | 8/1984 | (JP) . | |
| 359167266 | * | 9/1984 | (JP) | 347/44 |
| 60-071260 | | 4/1985 | (JP) . | |
| 60-255473 | | 12/1985 | (JP) | B41J/19/18 |
| 5069553 | | 3/1993 | (JP) | B41J/2/165 |

* cited by examiner

*Primary Examiner*—John Barlow
*Assistant Examiner*—M. Brooke
(74) *Attorney, Agent, or Firm*—Fitzpatrick, Cella, Harper & Scinto

(57) ABSTRACT

An ink jet recording system for performing recording by scanning a carriage having an ink jet recording cartridge, at least a part of which is removably mounted to said carriage, scans a carriage along a path that has a waiting position wherein access to the cartridge is inhibited and has a replacement position wherein the removably mounted part of the cartridge can be easily accessed, and in response to a cartridge replacement signal, moves the carriage to the replacement position. When the cartridge has been replaced, the carriage is returned to the waiting position.

32 Claims, 22 Drawing Sheets

INK JET CARTRIDGE REPLACEMENT CONTROL

BACKGROUND OF THE INVENTION

1. Field of the Invention

This invention relates to controlling replacement of an ink cartridge. More specifically, the invention relates to ink jet cartridge replacement control applicable to an ink jet recording apparatus and a facsimile apparatus using an jet recording apparatus.

2. Description of Related Art

A facsimile apparatus with a known ink jet recording system is shown in FIG. 10.

In a reading section an original 82 is loaded with its image side down on an original loading tray 81, positioned in the width direction by a guide 83. Reading of the original commences by a command from an operational panel 84. The original 82 is fed by a preliminary feed roller 85*a* and a preliminary feed press part 85*b*, with each sheet being fed separately by the action of a separating roller 86*a* and a separating press part 86*b*. The original 82 is fed by feed rollers 87*a* and 87*b* to a read position. An image of the original 82 is read out by a photoelectric conversion sensor 88. The original 82 after image reading is ejected by discharge rollers 89*a* and 89*b*. The original 82 is discharged onto a discharge section structured by a cover 90 and an original discharge tray 91 with a part 91*a* configured to fit into a gap 90*a* in the cover 90. The discharge tray 91 is assembled by inserting the part 91*a* into the gap 90*a* prior to an original reading operation.

A recording section records on recording paper 93 loaded and accommodated within a cassette 92 installed on the lower part of an apparatus body. Individual recording paper sheets are fed sheet-by-sheet by a paper feed roller 94 contacting the top side of the upper sheet. The recording paper 93 is then fed by a feed roller 95 to a platen roller 96 that is temporarily stopped. The platen roller 96 aligns the paper to remove any canting in the feed direction by providing a nip between a roller pair, against which nip the paper's leading edge is brought to bear. The platen roller also determines the feeding speed of the recording paper 93 relative to recording means.

An ink jet cartridge 97 used as such recording means is an exchangeable-type cartridge integrally formed by a recording head and an ink tank. The ink jet cartridge 97 is mounted on a carriage 98 which scans bidirectionally in a main scanning direction transverse to the sub-scanning direction, defined by the recording paper feed direction. The ink jet cartridge 97 discharges ink to record on the recording paper 93 in accordance with image information, and the recording paper 93 is fed by the platen roller 96. After image recording on one page is complete, the page is fed by a pair of feeding rollers 99*a* and 99*b*, and a pair of discharge rollers 100*a* and 100*b*, until it is discharged onto a recording paper discharge tray 101.

In the case where the ink level of the ink jet cartridge 97 is insufficient for recording, or there is an ink discharge failure, or the recording paper 93 has jammed, and so on, the cartridge 97 may need to be replaced in a manner explained by referring FIG. 11.

An operator detaches the original discharge tray 91 shown in FIG. 10 from the cover 90 and then detaches the cover 90 by rotating it on a hinge 90*b*. Then, an upper part of the recording section is opened to form a space 102. After the ink jet cartridge 97 is removed in the direction of the arrow shown in FIG. 11, a new ink jet cartridge is installed. After that, the cover 90 is closed by rotating it on the hinge 90*b* to the left in FIG. 11, the original discharge tray 91 is inserted into the gap 90*a*, and operation can be resumed.

In the prior art, the carriage 98 mounting the ink jet cartridge 97 is usually in a recording-waiting position called a home position during a non-recording period. In order to prevent the viscosity of the ink from increasing due to evaporation of the ink solvent or mixing of foreign materials in the ink, an ink discharge opening section of the ink jet cartridge 97 is sealed from ambient atmosphere by a cap comprised of elastic material. The recording-waiting position is at an end of the main scanning direction, so that even when the cover 90 is rotated to open the upper part of the recording section, it can be difficult to replace the ink jet cartridge 97 at the recording-waiting position. That is, in a construction in which the waiting position is covered in order to prevent a user from touching the ink jet cartridge 97 if its temperature is elevated through discharging large amounts of ink, it is difficult to replace the ink jet cartridge 97 even though the cover 90 is opened. If an operator changes the ink jet cartridge 97 while it is away from the waiting position, and then fails to return it to the waiting position, thereby leaving it exposed for an extended time after replacement of the ink jet cartridge 97, the ink discharge opening section will remain exposed, and faulty ink discharge may occur because of increased ink viscosity or presence of foreign materials in the ink.

SUMMARY OF THE INVENTION

One object of the present invention is to provide ink jet recording apparatus in which an ink jet recording means such as an ink jet cartridge can be easily replaced.

It is another object of the invention to provide the ink jet recording apparatus in which a scanning carriage can easily and with certainty be returned to a predetermined waiting position after replacing an ink jet cartridge removably mounted on the carriage.

It is still another object of the invention to provide an image forming apparatus and a cartridge replacement control method which can prohibit transition to a replacement mode of a recording head cartridge at a time when a temperature of the recording head is high, even though a cover for providing access to the recording head cartridge is opened.

In accordance with one aspect of the invention, an ink jet recording apparatus for performing recording by scanning a carriage having an ink jet recording cartridge, at least a part of which is removably mounted to the carriage, comprises scanning means for moving the carriage in a predetermined path having a waiting position wherein access to the ink jet recording cartridge is inhibited and a replacement position wherein access to at least the removably mounted part of the cartridge is facilitated, and control means for controlling the scanning means for movement of the carriage between the waiting position and the replacement position, wherein the control means moves the carriage to the waiting position from the replacement position in the presence of a recording start signal indicating that recording is to commence.

In accordance with another aspect of the invention, an ink jet recording apparatus for performing recording by scanning a carriage having an ink jet recording cartridge, at least a part of which is removably mounted to the carriage, comprises scanning means for moving the carriage in a predetermined path having a waiting position wherein access to the ink jet recording device is inhibited and a replacement position wherein access to at least the removably mounted part of the cartridge is facilitated, control means for controlling the scanning means for movement of the carriage to the replacement position in response to a cartridge replacement signal, a timer for counting the time elapsed from generation of the cartridge replacement signal, and return means for causing the scanning means to move the carriage to the waiting position from the replacement position when the elapsed time exceeds a predetermined time.

In accordance with yet another aspect of the invention, an ink jet recording apparatus for performing recording by scanning a carriage having an ink jet recording cartridge, at least a part of which is removably mounted to the carriage, comprises scanning means for moving the carriage in a predetermined path having a waiting position wherein access to the ink jet recording device is inhibited and a replacement position wherein access to at least the removably mounted part of the cartridge is facilitated, a cover section movable to an open position for exposing the removably mounted part of the cartridge when said carriage is in the replacement position, detecting means for detecting opening and closing of the cover section and generating, respectively, a cover-open signal and a cover-closed signal, input means for inputting a cartridge replacement signal, control means for controlling the scanning means for movement to the replacement position in response to said cartridge replacement signal and the cover-open signal, and return means for causing the scanning means to move the carriage to the waiting position from the replacement position in the presence of a cover-closed signal, a second cartridge replacement signal or a recording start signal indicating that recording is to commence, or after a predetermined time elapses from when the control means moved the carriage to the replacement position.

In accordance with still another aspect of the invention, an ink jet recording apparatus for performing recording by scanning a carriage having an ink jet recording cartridge, at least a part of which is removably mounted to the carriage, comprises scanning means for moving the carriage in a predetermined path having a waiting position wherein access to the ink jet recording cartridge is inhibited and a replacement position wherein access to at least the removably mounted part of said cartridge is facilitated, control means for controlling the scanning means for movement of the carriage between the waiting position and the replacement position, wherein the control means moves the carriage to the replacement position in response to a cartridge replacement signal, and return means for returning the carriage to the waiting position in response to at least one of plural return conditions.

In one method aspect of the invention, an ink jet cartridge replacement control method for controlling replacement of at least a removably mounted part of an ink jet cartridge used to record by ejecting ink comprises the steps of providing a carriage movable in a predetermined path having a waiting position wherein access to the ink jet recording cartridge is inhibited and a replacement position wherein access to at least the removably mounted part of the cartridge is facilitated, and returning the carriage to the waiting position from the replacement position in the presence of a recording start signal indicating that recording is to commence.

In another method aspect of the invention, an ink jet cartridge replacement control method for controlling replacement of at least a removably mounted part of an ink jet cartridge used to record by ejecting ink comprises the steps of providing a carriage movable in a predetermined path having a waiting position wherein access to the ink jet recording cartridge is inhibited and a replacement position wherein access to at least the removably mounted part of said cartridge is facilitated, moving the carriage to the replacement position in response to a cartridge replacement signal, counting the time elapsed from generation of the cartridge replacement signal, and returning the carriage to the waiting position from the replacement position when the elapsed time exceeds a predetermined time.

In yet another method aspect of the invention, an ink jet cartridge replacement control method for controlling replacement of at least a removably mounted part of an ink jet cartridge used to record by ejecting ink comprises the steps of providing a carriage movable in a predetermined path having a waiting position wherein access to the ink jet recording cartridge is inhibited and a replacement position wherein access to at least the removably mounted part of the cartridge is facilitated, providing a cover section movable to an open position for exposing the removably mounted part of the cartridge when the carriage is in the replacement position, detecting opening and closing of the cover section and generating, respectively, a cover-open signal and a cover-closed signal, inputting a cartridge replacement signal, moving the carriage to the replacement position in response to the cartridge replacement signal and the cover-open signal, and returning said carriage to the waiting position from the replacement position in the presence of a cover-closed signal, a second cartridge replacement signal or a recording start signal indicating that recording is to commence, or after a predetermined time elapses from when said control means moved the carriage to said replacement position.

In still another method aspect of the invention, an ink jet cartridge replacement control method for controlling replacement of at least a removably mounted part of an ink jet cartridge used to record by ejecting ink comprises the steps of providing a carriage movable in a predetermined path having a waiting position wherein access to the ink jet recording cartridge is inhibited and a replacement position wherein access to at least the removably mounted part of said cartridge is facilitated, moving the carriage to the replacement position from the waiting position in response to a cartridge replacement signal, and returning the carriage to the waiting position in response to at least one of plural return conditions.

In another aspect of the invention, an image forming apparatus comprises a recording section including a carriage for scanning an ink jet recording cartridge for performing recording, at least a part of the cartridge being removably mounted to the carriage, and scanning means for moving the carriage in a predetermined path having a waiting position wherein access to the ink jet recording cartridge is inhibited and a replacement position wherein access to at least the removably mounted part of the cartridge is facilitated, and a main control section including input means for inputting an image signal, processing means for processing the image signal for recording by the recording section, instructing means for instructing the scanning means to move the carriage to the replacement position, judging means for judging whether the part of the cartridge can be replaced in response to an instruction from the instruction means, and control means for moving the carriage to the replacement position when the judging means judges that the part of the cartridge can be replaced, for interrupting movement of the carriage to the replacement position when the judging means judges that the part of the cartridge cannot be replaced, and for moving the carriage to the replacement position when the judging means judges that the part of the cartridge can be replaced after the judging means had judged that the part of the cartridge could not be replaced.

In accordance with another method aspect of the invention, a cartridge replacement control method for use with an image forming apparatus comprising (1) a recording section including a carriage for scanning an ink jet recording cartridge for performing recording, at least a part of the cartridge being removably mounted to the carriage, and scanning means for moving the carriage in a predetermined path having a waiting position wherein access to the ink jet recording cartridge is inhibited and a replacement position wherein access to at least the removably mounted part of said cartridge is facilitated, and (2) a main control section including input means for inputting an image signal, and processing means for processing the image signal for recording by the recording section, comprises the steps of instructing the scanning means to move the carriage to the replacement position, judging whether the part of the cartridge can be replaced in response to an instruction of the instructing step, moving the carriage to the replacement position when a result of the judging step is that the part of the cartridge can be replaced, interrupting movement of the carriage to the replacement position when the result of the judging step is that the part of the cartridge cannot be replaced, and moving the carriage to the replacement position when the result of the judging step is changed to indicate that the part of the cartridge can be replaced after the interrupting step.

These and other objects and aspects of the invention will be apparent from the detailed description, which follows below, when taken in conjunction with the accompanying drawings described briefly as follows.

PREFERRED EMBODIMENTS OF THE INVENTION

Figure 1:
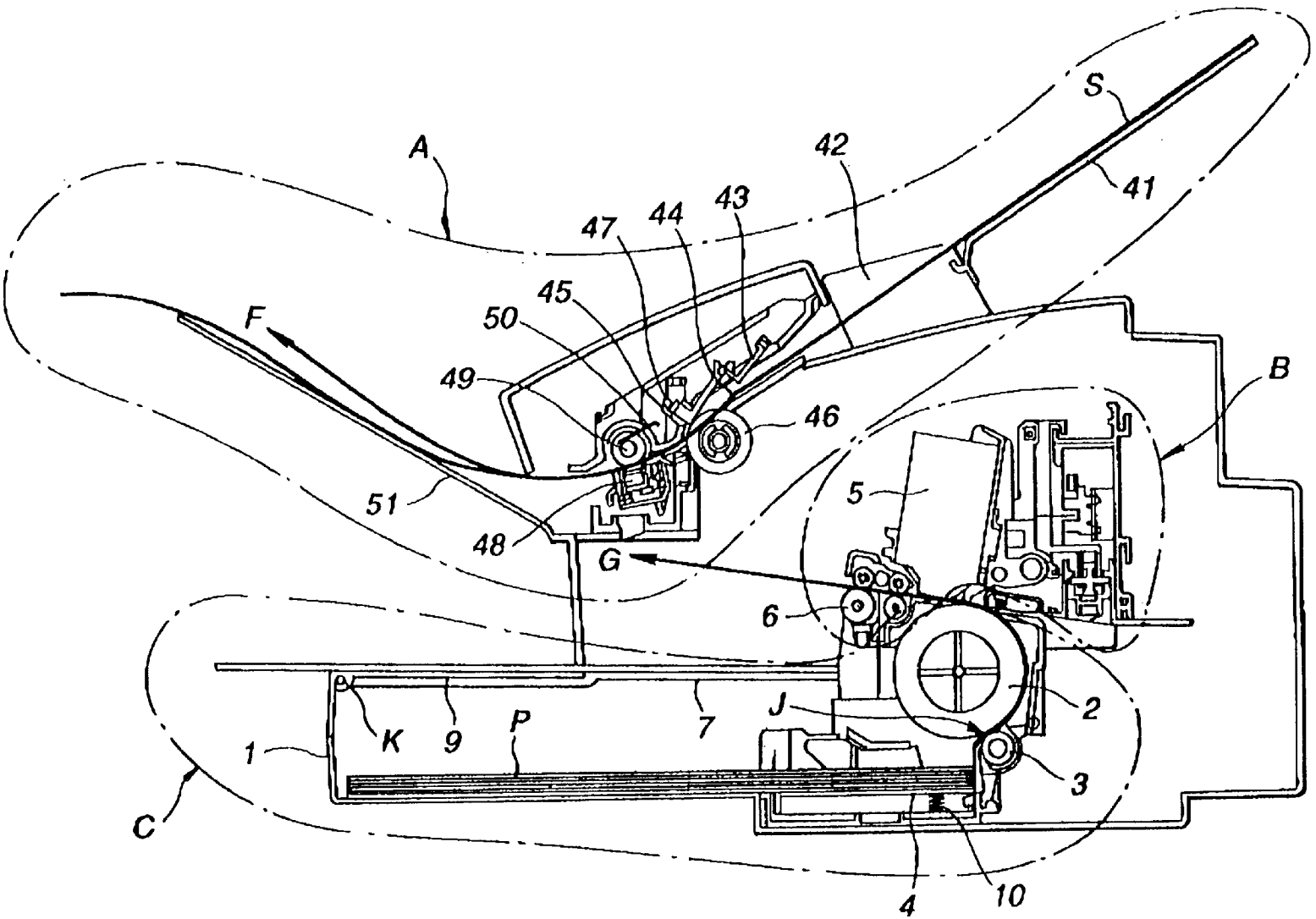
FIG. 1 is a sectional view of a facsimile apparatus incorporating the present invention.
Figure 2:
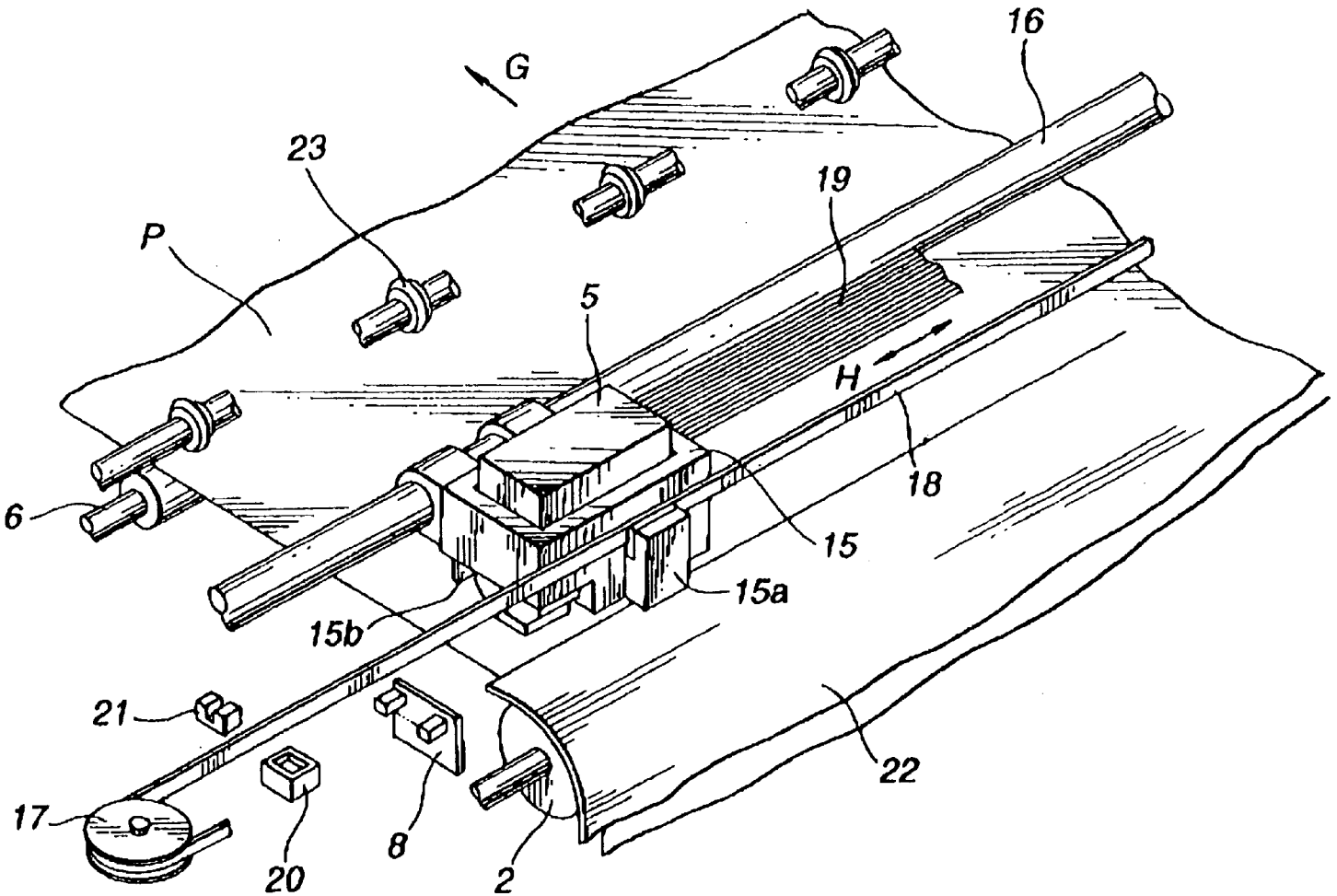
FIG. 2 is a perspective view of a principal portion of a recording section of the facsimile apparatus of FIG. 1.

Preferred embodiments of the present invention will be described with reference to the drawings. In the following embodiments the present invention is applied to a facsimile apparatus, although that is not meant to limit the scope of the invention. FIG. 1 is a sectional view of facsimile apparatus incorporating the present invention and FIG. 2 is a perspective view of a principal portion of a recording section of such a facsimile apparatus.

The facsimile apparatus in FIG. 1 comprises a read unit A that optically reads an original, a recording unit B that is, an ink jet recording apparatus for recording on a recording medium by ejecting ink from a recording head, and a paper feed unit C for separating sheets such as recording papers loaded on a sheet cassette and supplying them to the recording unit B.

The recording paper P traverses the path generally shown by an arrow G. The recording paper P is loaded on a feed cassette 1 of the feed unit C and is picked up by a paper feed roller 2 and retard roller 3 and sent to the recording unit B by the paper feed roller 2.

In the recording unit B, the recording paper P is recorded by a recording head on a cartridge 5. After the recording paper is fed in the apparatus a certain distance, it is discharged to a discharge stacker 7, acting as discharge loading means, by a discharge roller 6.

The feed cassette 1 stores plural accumulated sheets of recording paper P. Within the feed cassette 1 there is a board 4 on which the recording paper P is loaded. This board 4 is biased upward toward the feed roller 2 from underneath by a board spring 10 facing feed roller 2. The board 4 is pressed downward by a cam in a feed-waiting interval, and as recording paper P is consumed, the spring 10 enables recording paper P to be supplied by the feed roller 2.

When a feed operation is started by detection of a recording signal, the pressing action of the cam on the board 4 is released, and recording paper P is picked up by the paper feed roller 2. The retard roller 3 is provided in a location facing the paper feed roller 2 and changes its position in accordance with the movement of the board 4. When a feed operation is performed, the retard roller 3 is biased toward the paper feed roller 2. Only the uppermost paper of the stack of recording paper P is picked up by the feed roller 2, and separated for feeding by the retard roller 3 and the paper feed roller 2, in the section marked J in FIG. 1. The recording paper P sheet is thus fed to the recording unit B described in detail later below.

A discharging structure to discharge the recording paper P recorded by the recording unit B will now be explained further by referring FIG. 1. As mentioned above, the recording paper P is discharged by the discharge roller 6 onto the discharge stacker 7. On the discharge stacker 7, a discharge auxiliary tray 9 rotates about the hinge K. When long recording paper P is used, the discharge stacker 7 can be extended by rotating the auxiliary tray 9. In its extended position the discharge stacker 7 forms part of the cover of the paper cassette 1.

The feed path of an original S is shown generally by an arrow F. In FIG. 1, an original loading tray 41 provides a location where an original S is loaded with its image surface down. The original S loaded on the original loading tray 41 is positioned by a slider 42 movable in the width direction of the original. A preliminary feed press part 43 is pressed from above by a preliminary feed spring 44, and it handles the original S by cooperating with a separating roller 46. A separating part 45 presses a separating roller 46 from above by the action of an ADF (automatic document feed) spring 47. Each original S is individually fed separately from its lower side by cooperation of the separating part 45 with the separating roller 46. The separating roller 46 thus functions to feed the original S to a document reading position.

A photoelectric conversion sensor 48 reads an image of an original S fed thereto by the separating roller 46. A roller 49 is passed from above by a press spring 50 along a read line of the photoelectric conversion sensor 48, and thereby an image surface of the original S is made to contact the sensor 48 closely along a read line. The roller 49 determines the speed in the sub-scanning direction of the original S, and also discharges the original S when reading is complete. An original discharge tray 51, which accepts the original, is detachable from the body of the apparatus.

The structure of a recording section of the recording unit B will be explained by referring FIG. 2. The ink jet cartridge 5 of this embodiment contains an ink tank and has an ink jet head, and can be replaced with a new cartridge when ink in the ink tank is consumed. The ink jet recording means of the present invention may also be provided as an ink jet head and an ink tank that are detachable from each other. In this case, just the ink jet head or ink tank can be replaced as needed.

The ink jet cartridge 5 can be made as a monochrome cartridge and color cartridge, either of which can be replaced with the other. A head of the monochrome cartridge will typically have a nozzle array arranged as 128 individual nozzles (discharge openings) in one line.

On the other hand, nozzles of a black ink section and nozzles of a color ink section may also be separately provided in a head of a color recording cartridge. The recording head of such a black section typically has 64 nozzles and the recording head of such a color section respectively has 24 nozzles for each of three colors, that is, cyan, magenta and yellow, and the nozzles for each are arranged in one line. Such cartridges typically have a resolution of 360 dpi (dots per inch) and discharge ink from discharge openings at an end of the nozzles by the pressure of film boiling caused in ink by heating a electrothermal conversion element provided in the nozzle. The color cartridge will typically have multiple ink tanks, that is, a black ink tank and color ink tanks, each of which can be replaced individually.

A carriage 15 scans ink jet cartridge 5 bidirectionally in a main scanning direction H perpendicular to the paper feed direction G (the subscanning direction). The carriage 15 is supported slideably by a guide shaft 16 and a contact section 15*a*. The carriage 15 is scanned bidirectionally by a pulley 17 driven by a carriage motor (not illustrated in FIG. 2) and a timing belt 18. Recording signals and electric power are supplied from an electric circuit of the apparatus body by way of a flexible cable 19.

A cap 20 functions as an ink receiving means and is arranged in correspondence to a waiting position (home position) of the carriage 15. The cap 20 can move up and down, if needed, and in its upper position closely contacts an ink discharge opening section of the ink jet cartridge 5 to cover the ink discharge opening section so as to prevent evaporation of ink therefrom and adhesion of foreign particles.

A carriage home sensor 21 provided on the apparatus body and a blocking tab 15*b* provided on the carriage 15 are used in locating the ink jet cartridge 5 relative to the cap 20. A transmission type photointerrupter is used as the carriage home sensor 21. When the carriage 15 moves to the waiting position, the light irradiated from a part of the carriage home sensor 21 is blocked by the blocking tab 15*b*. Because of those parts' relative locations, they detect that the ink jet cartridge 5 is in position facing the cap 20. Thereby, the carriage 15 can be moved to a home position comprising a predetermined waiting position.

The recording paper P is fed as discussed above in connection with FIG. 1, so that it is turned by the paper feed roller 2 and a paper guide 22 into a horizontal direction, and is thereby fed in the sub-scanning direction G. The paper feed roller 2 and the discharge roller 6 are driven to transport the recording paper P in the sub-scanning direction with high accuracy, in cooperation with the bidirectional movement of the carriage 15. Spurs 23 are made of a highly water-repellent material and have a blade-shaped circumferential section, the edge of which contacts the surface of the recording paper P. The spurs 23 are provided in two or more places where they face the discharge roller 6 and are spaced a predetermined distance apart from each other in the main scanning direction by a bearing member (not illustrated). Even though the spurs may contact an unfixed image on the recording paper P right after recording, they can feed the recording paper P without affecting the image because they are in contact with the paper only at the edges of the spurs 23.

A photosensor assembly 8 is arranged to face the nozzle array of the ink jet cartridge 5 between the cap 20 and an edge of the recording paper P. This is a transmission-type photointerrupter for optically detecting ink drops discharged from nozzles of the ink jet cartridge 5. Thereby, an empty state of the ink jet cartridge 5 can be detected. In the photosensor 8 used in this embodiment, a infrared LED (light emitting diode) is used as an illuminating element. A lens is formed integrally in the LED to project a beam onto a receiving element. A phototransistor is used as the receiving element and a square hole 0.7 mm by 0.7 mm on a light beam axis is molded just in front of a surface of the receiving element. Thereby, a detecting area is limited to 0.7 mm by 0.7 mm in width in the region between the illuminating element and the receiving element. The beam from the illuminating element to the receiving element is directed parallel to a nozzle line of the ink jet cartridge 5.

The distance between the illuminating element and the receiving element is greater than the length of a nozzle array of the ink jet cartridge 5. When a position of the beam axis and the line of nozzles of the ink jet cartridge 5 coincides, the ink drops discharged from each nozzle of the ink jet cartridge 5 pass through the light beam between the illuminating element and the receiving element. When ink drops intersect the beam, they block the light from the illuminating element so that an output of the phototransistor as the receiving element changes.

Figure 3:
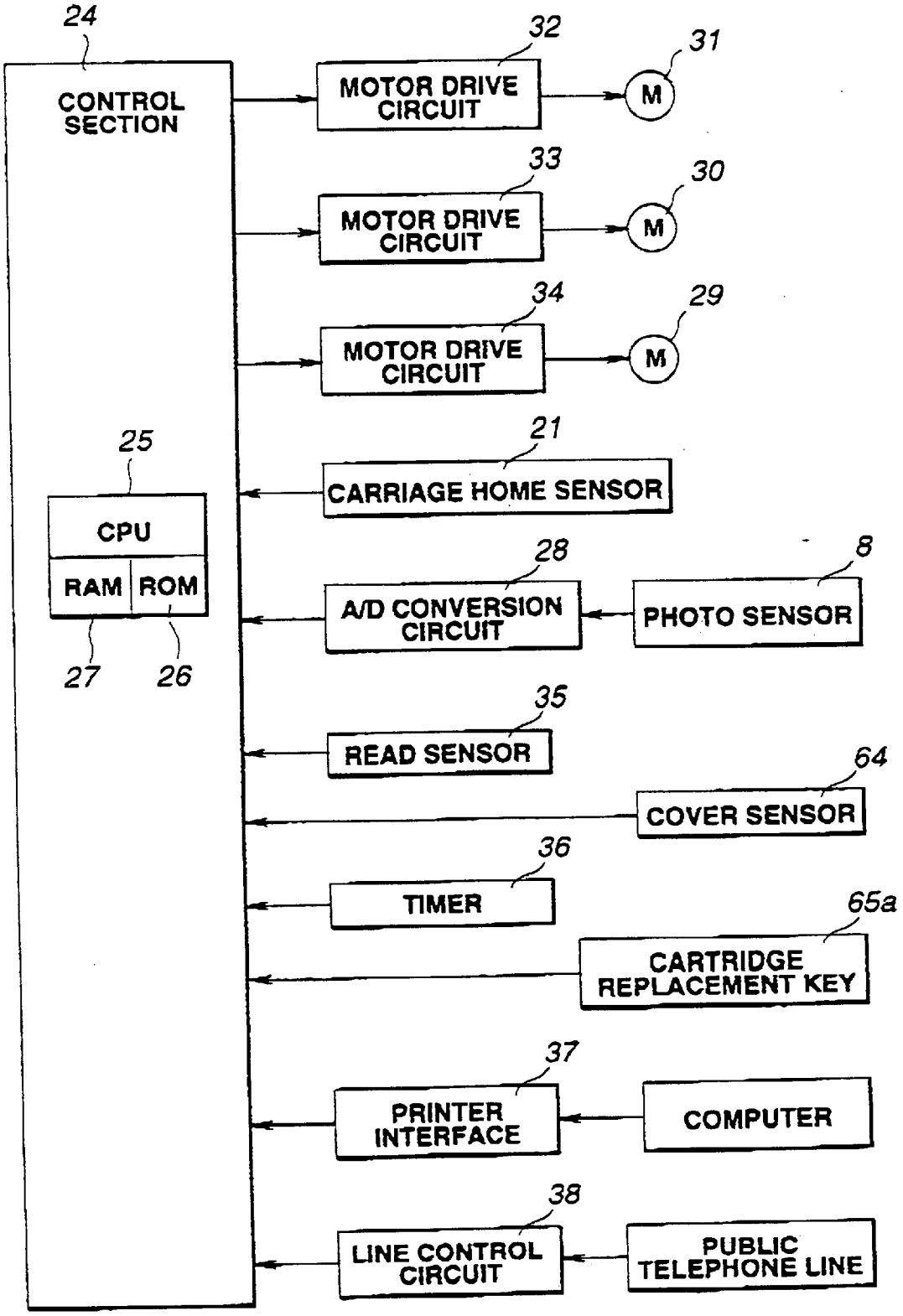
FIG. 3 is a block diagram of the facsimile apparatus of FIG. 1.

The principal portion of an electrical circuit of the facsimile apparatus will be explained by referring to the block diagram shown in FIG. 3. A control section 24 controls the recording apparatus, including movement of the carriage.

The control section 24 has a CPU 25 such as a microprocessor, a ROM 26 storing a control program of the CPU 25 and various data, and a RAM 27 used as a working area of the CPU 25 and for temporarily storing various data. An output of the photosensor 8 is digitized by an A/D conversion circuit 28 and analyses by the CPU 25. A rotation angle of a carriage motor 31 is controlled by the number of step pulses supplied by a motor drive circuit 32. The carriage motor 31 and its motor drive circuit 32, a recording paper motor 30 for feeding the recording paper and its motor drive circuit 33, an original feed motor 29 for feeding an original to be read and its motor drive circuit 34, and a carriage home sensor 21, are connected with the control section 24.

An image data input device such as a read sensor 35 for optically reading the original image, a printer interface 37 for receiving recording commands from an computer, a line control circuit 38 for receiving data from a public telephone line (that is, communication means with an outside apparatus) are also connected with the control section 24. Therefore, the apparatus can function as a facsimile machine, a copy machine and a printer for a computer. Moreover, when the CPU 25 detects outputs of a cover sensor 64 and a cartridge replacement key 65*a*, it actuates a timer 36.

An operation for replacing the ink jet cartridge 5 will be explained by referring to FIGS. 4, 5 and 6. FIG. 6 is a flow chart of the replacement operation of the ink jet cartridge as performed by the control section 24. It will be indicated by the output of the photosensor 8, which can detect an ink nondischarge condition when the nozzle line of the ink jet cartridge 5 is in the detection range between the illuminating and receiving elements of the photosensor 8, that the ink cartridge 5 should be replaced. A warning (step S1) is indicated on an indication display 65*b* (FIG. 4) when non-discharge of ink is detected. The warning shows that the ink cartridge needs replacing. The indication display 65*b* may use liquid crystal displays or light emitting diodes.

Figure 5:
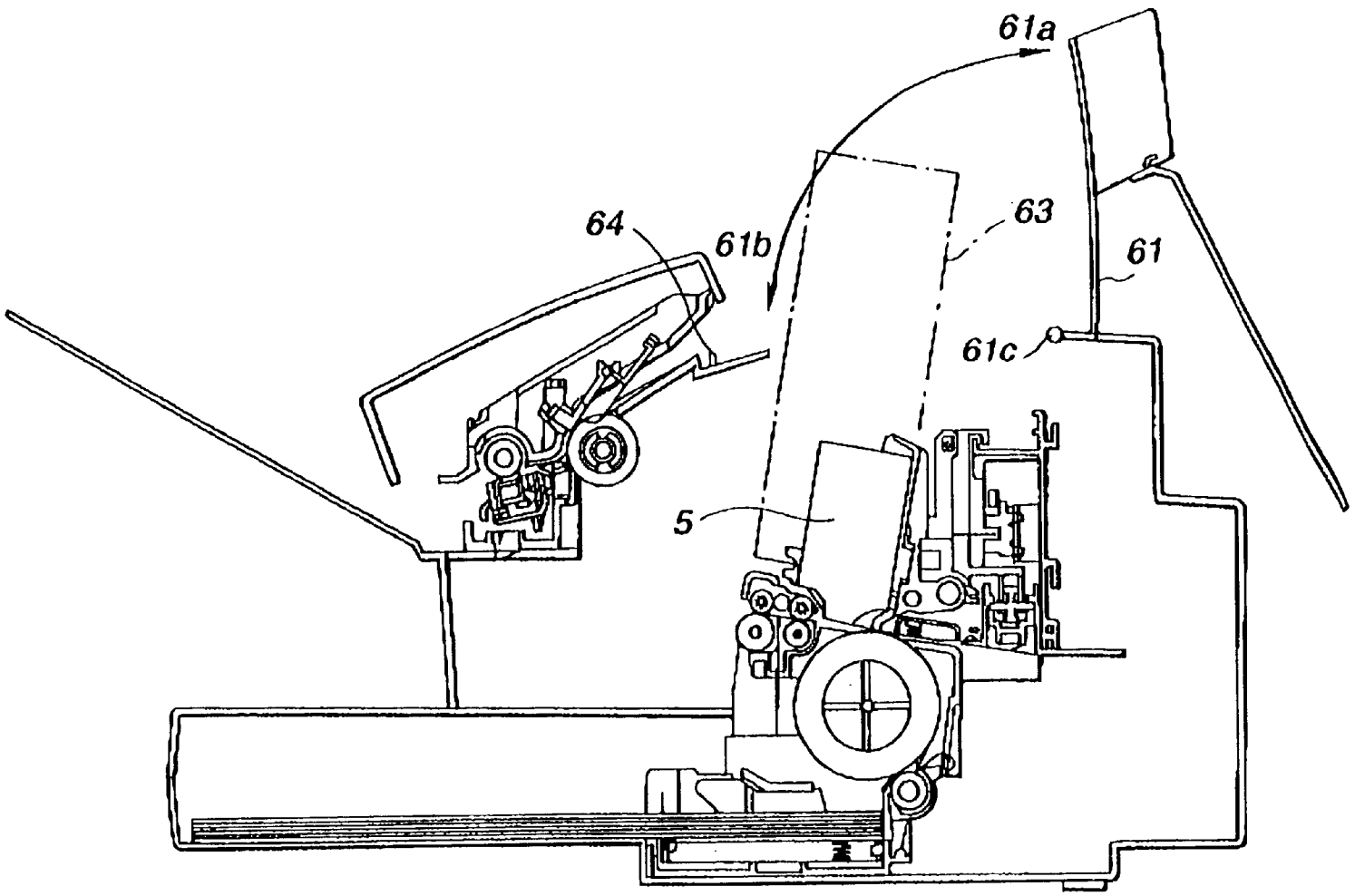
FIG. 5 is a sectional view of the facsimile apparatus of FIG. 1, showing the cover in the open position.
Figure 6:
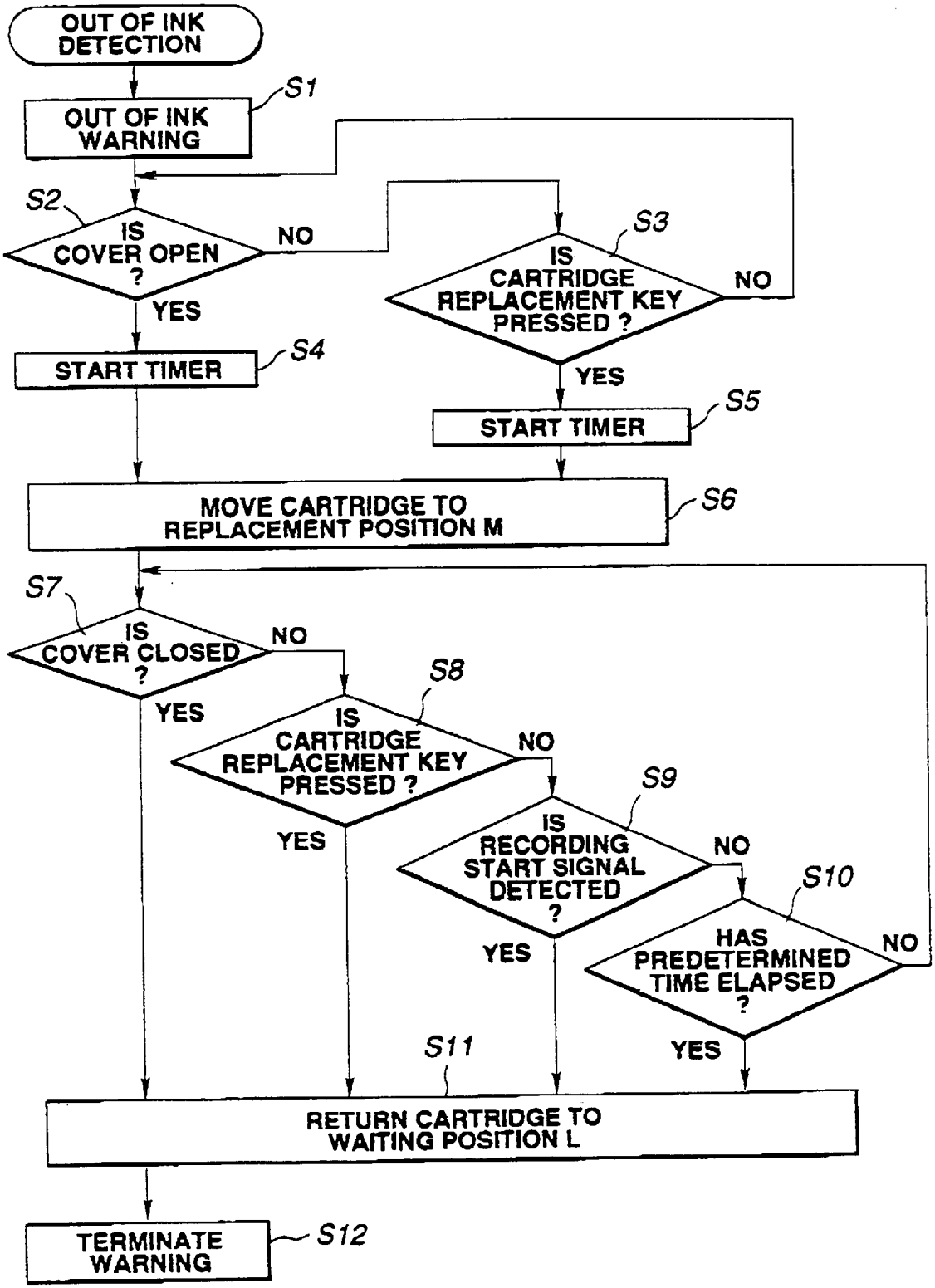
FIG. 6 is a flow chart of an operation to replace an ink jet cartridge in the facsimile apparatus of FIG. 1.

In order to replace the ink jet cartridge 5, a user opens the cover 61 about the hinge 61*c* in the direction of an arrow 61*a* as shown in FIG. 5, and thus provides an open space 63. A cover sensor 64 acts as lid section detecting means formed by a mechanical switch to detect opening and closing of the cover 61.

Figure 4:
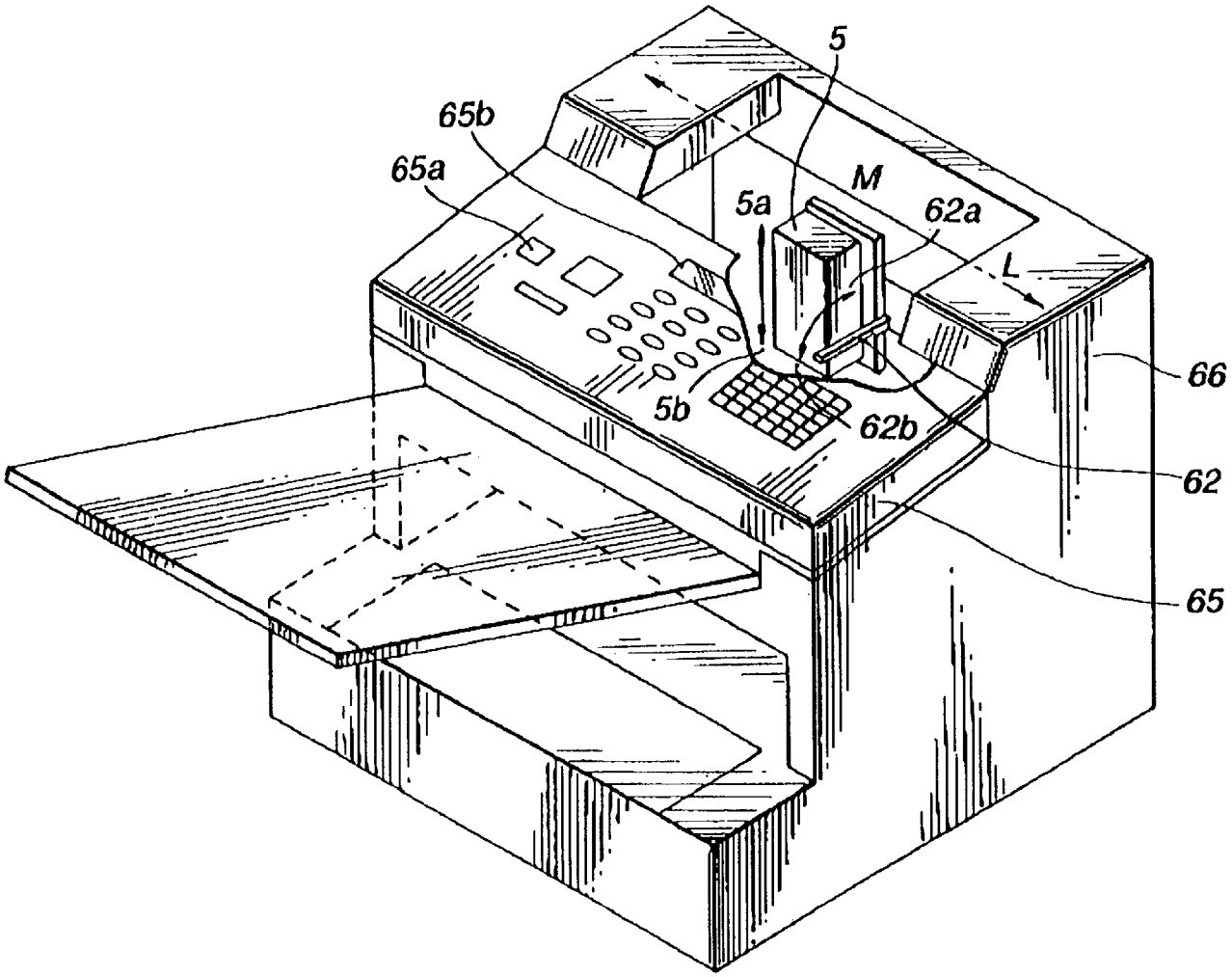
FIG. 4 is a perspective view of the facsimile apparatus of FIG. 1.

FIG. 4 shows the cover 61 opened as in FIG. 5, but the opened cover 61 is omitted in FIG. 4 for clarity. Usually, the ink jet cartridge 5 waits at a home position, that is, at a waiting position L at the right of the apparatus body in FIG. 4.

Part of a body cover 66, however, shields the ink jet cartridge 5 from above so that the user cannot reach the ink jet cartridge 5 easily when the ink jet cartridge 5 waits at the section L. This is because a temperature of the head of the ink jet cartridge 5 may be elevated just after discharging a great amount of ink, especially in case of a head having a large number of nozzles. When the cover 61 is opened (Yes in step S2) or a cartridge replacement key 65*a* marked with a "CARTRIDGE OUT" legend, is pressed (Yes in step S3), the ink jet cartridge 5 moves to a replacement position, that is, a position M that is roughly a middle position of the apparatus body (step S6). The replacement by 65*a* and indication display 65*b* are on an operation panel 65.

To move the cartridge 5 the carriage 15 is controlled by the motor drive circuit 32 and the carriage motor 31 based on a drive signal output from the control section 24. The control section 24 supplies a predetermined number of step drive pulses to the carriage motor 31 to move the carriage 15 from the waiting position L to the replacement position M. The CPU 25 detects opening of the cover 61 based on an output change of the cover sensor 64. The CPU 25 also detects pressing of the cartridge replacement key 65*a*. The position M is predetermined as the position where replacement of the ink jet cartridge is easier than at the position L. Since the space 63 is formed a the position M, the user can easily reach and replace the ink cartridge 5. The ink cartridge 5 may be controlled not to move to the replacement position M, even though replacement is demanded, when the temperature of the ink jet cartridge 5 is high. In this case, the head temperature is detected by a temperature sensor (not shown).

A lever 62 is used to detach the ink jet cartridge 5 from the carriage 15. After the ink jet cartridge 5 moved to the position M, the ink jet cartridge 5 can be detached in the direction of an arrow 5*a* by rotating the lever 62 in the direction of an arrow 62*a*.

A new ink jet cartridge 5 is then fitted to the carriage 15 in the direction of an arrow 5*b* while the lever 62 remains rotated in the direction of arrow 62*a*. Then, when the lever 62 is rotated in the direction of an arrow 62*b*, installation of the new ink jet cartridge 5 to the carriage 15 is completed.

When the user closes the cover 61 (in the direction of arrow 61*b*) after the installation of a new ink jet cartridge 5 on the carriage 15, the cover sensor 64 detects that the cover is closed (Yes in step S7) and sends a signal to the control section 24. The control section 24 then drives the carriage motor 31 from the M position in the direction of the waiting position L. When the carriage home sensor 21 detects that the carriage 15 has moved to the waiting position L, the control section 24 stops moving the carriage 15 at that position (step S11). Afterward, an ink discharge opening section of the ink jet cartridge 5 is capped by the cap 20, and a suction pump (not shown) performs a suction discharge operation, and then the ink jet cartridge 5 is in a recording-waiting condition.

In that condition the ink discharge opening section (the nozzle array) of the ink jet cartridge S is shielded by the cap 20 from ambient air until recording starts. Thus, an increase in ink viscosity and the adherence of ink in the ink discharge opening section, and mixing of foreign materials, can be prevented, which allows the ensuing recording operation to be performed properly. The control section 24 then terminates the warning indicated on the indication display 65*b* (in step S12).

When the control section 24 detects that the cartridge replacement key 65*a* is pressed again while the cover is still open (Yes in step S8), the carriage 15 moves to the waiting position L in a manner similar to that after the cover is closed (in step S11). In addition, when the control section 24 detects that a recording start signal is output, but the key 65*a* has not been pressed again (Yes in step S9), it moves the carriage 15 to the waiting position L (in step S11).

When the control section 24 detects that the cover 61 is opened in step S2 or that the cartridge replacement key 65*a* is pressed, the timer 36 starts to count (in steps S4 and S5). Then, if the operation reaches step S10, the control section 24 detects whether or not a predetermined time has passed after the timer 36 started to count. If so, the control section 24 moves the carriage 15 to the waiting position L automatically and with certainty (in step S11), even though the cover is not closed, the cartridge replacement key is not pressed and no recording signal has been detected.

In this embodiment, movement to the replacement position M is in response to opening of the cover 61 or pressing of the replacement key 65*a*. Return movement to the waiting position L is in response to closing the cover 61, pressing of the replacement key 65*a*, output of the recording start signal, or the elapsed time of the timer 36. In this way, the cartridge can be returned to the waiting position automatically corresponding to various conditions after replacement of the ink jet cartridge.

Figure 7:
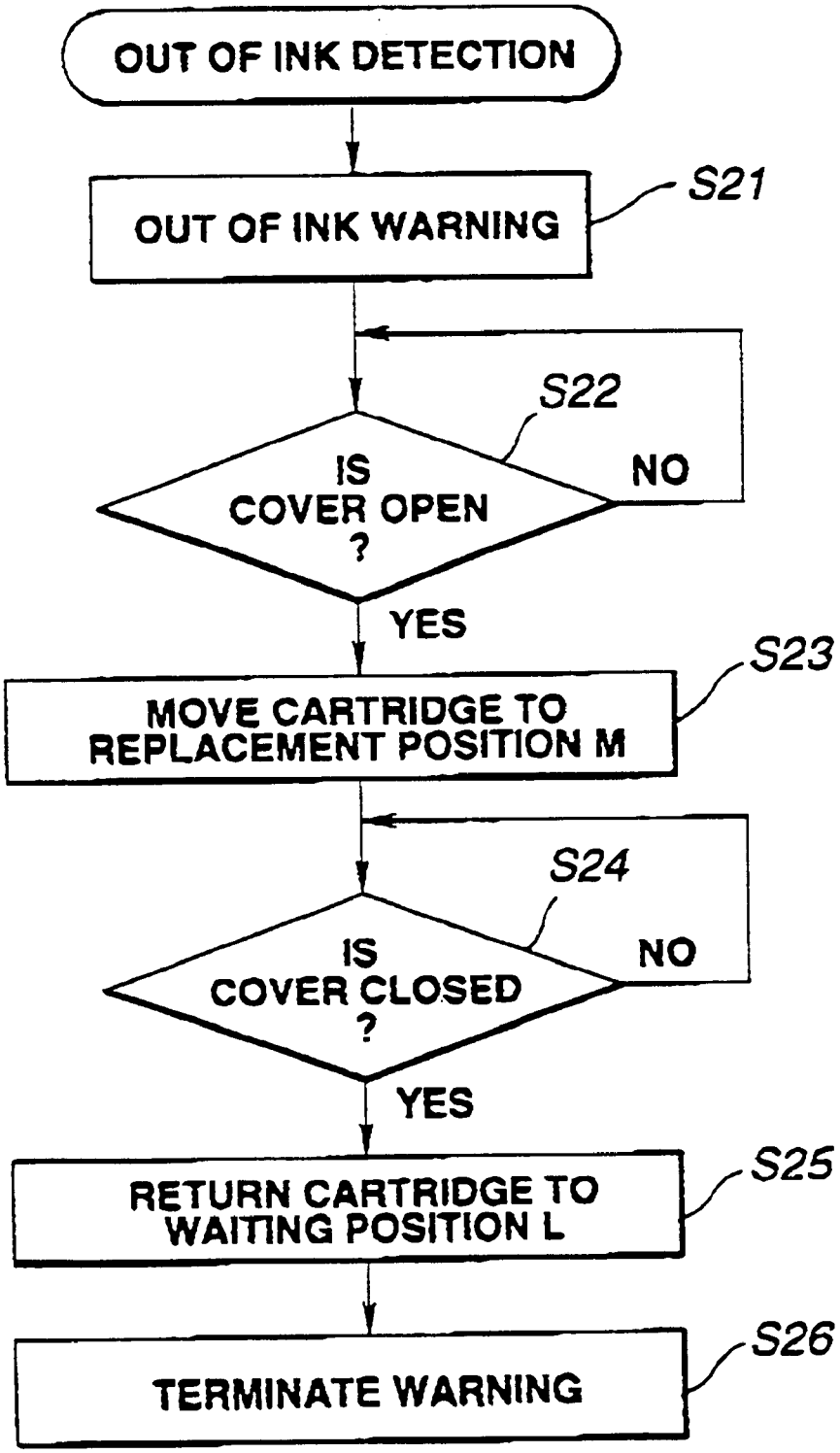
FIG. 7 is a flow chart of an alternate operation to replace an ink jet cartridge in the facsimile apparatus of FIG. 1.

FIG. 7 is a flow chart showing an alternate operation of the control section 24. In FIG. 7, when the control section 24 detects that the cover is opened (Yes in step S22), it moves the carriage 15 to the replacement position M (step S23). If it then detects that the cover 61 is closed (Yes in step S24), it returns the carriage 15 to the waiting position L (step S25). In this embodiment, movement to the replacement position M is in response to opening the cover 61. The return movement is in response to closing the cover 61.

Figure 8:
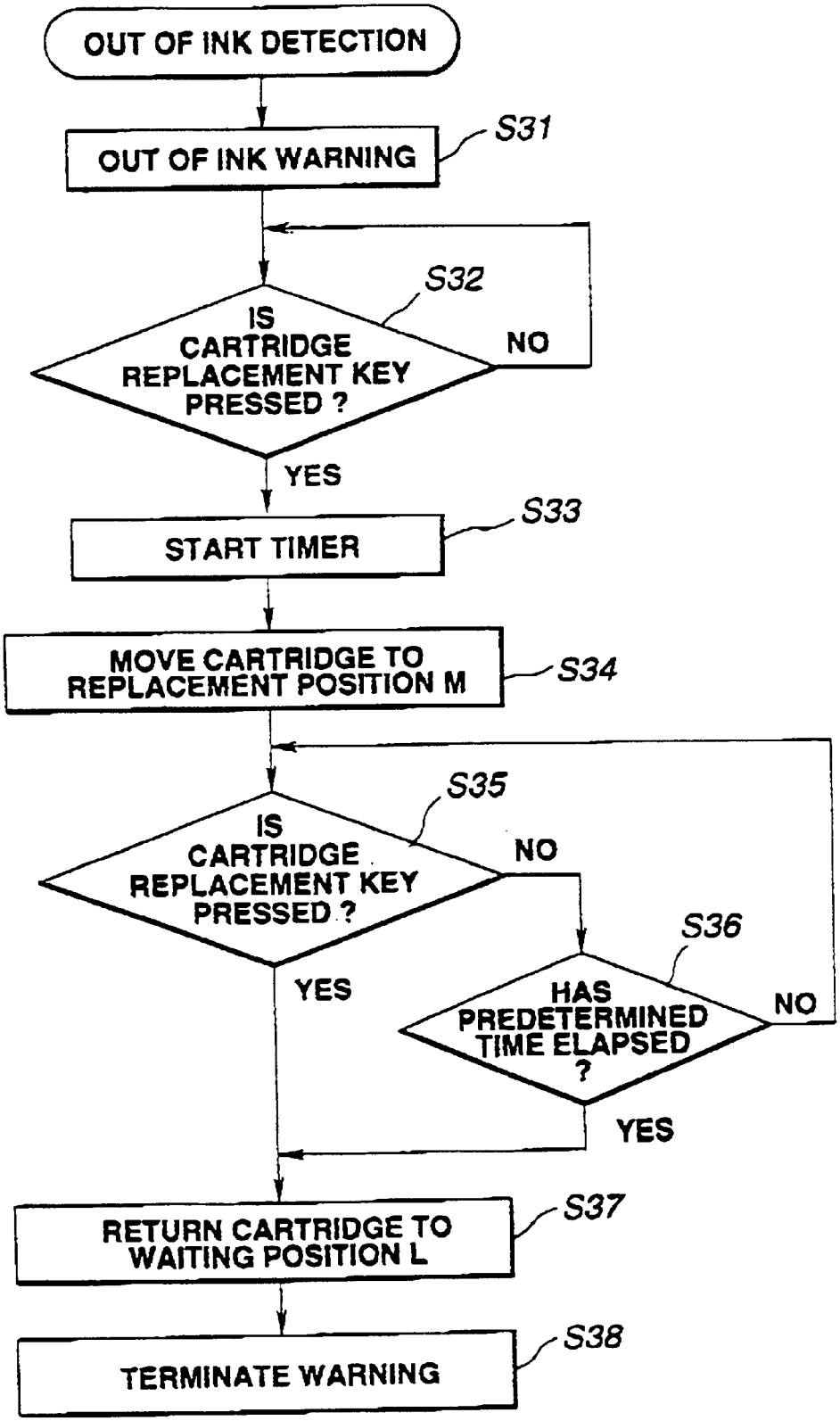
FIG. 8 is a flow chart of still another alternative operation to replace an ink jet cartridge in the facsimile apparatus of FIG. 1.

FIG. 8 is a flow chart showing still another operation for cartridge replacement. When the control section 24 detects that the cartridge replacement key 65*a* is pressed (Yes in step S32), it moves the carriage 15 to the replacement position M (step S34) and the timer 36 starts to count (step S33). When the control section 24 detects the cartridge replacement key 65*a* is pressed again (Yes in step S35), it moves the carriage 15 to the waiting position L (step S37). Or, if the control section 24 detects that a predetermined time has passed after the timer 36 started to count (Yes in step S36), the control section 24 moves the carriage 15 to the waiting position automatically L (in step S37), even though the cartridge replacement key 65*a* is not pressed again. In this embodiment, the movement to the replacement position is in response to pressing the replacement key 65*a*. Return movement to the waiting position L is in response to pressing the replacement key 65*a* or the elapsed time of the timer 36.

As a modification for the above operation, movement to the replacement position may be in response to opening the cover 61 and return movement to the waiting position may be in response to pressing the replacement key 65*a*. Conversely, movement to the replacement position may be in response to pressing the replacement key 65*a* and return movement to the waiting position may be in response to closing the cover 61. Further, return the movement may be in response to the output of the recording start signal.

Generally, the return movement need not be in response to closing the cover 61, pressing the replacement key 65*a*, or output of the recording start signal, but may be solely in response to the elapsed time of the timer 36. In fact, the present invention can combine any condition of the movement to the replacement position and any condition of the return movement to the waiting position. The user can replace the ink jet cartridge easily and with certainty because movement to the replacement position or return to the waiting position can be performed by satisfying one or more plural conditions.

Figure 9:
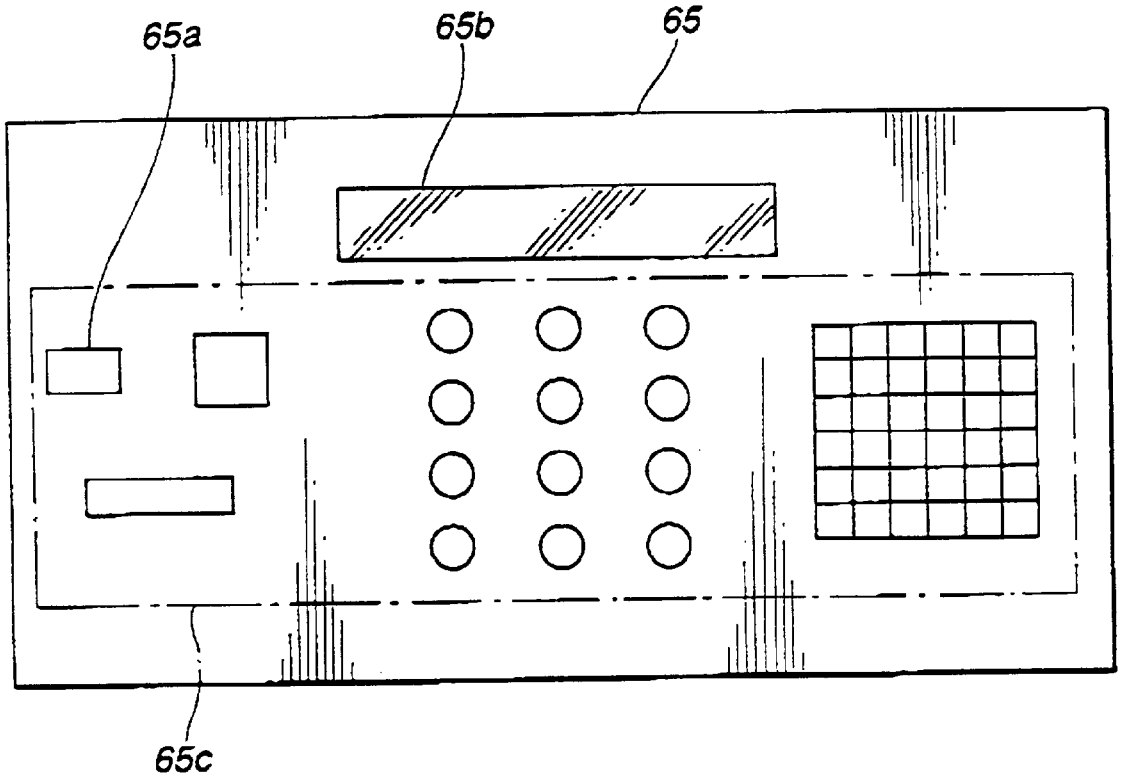
FIG. 9 is an enlarged view of an operational panel of the facsimile apparatus of FIG. 1.
Figure 10:
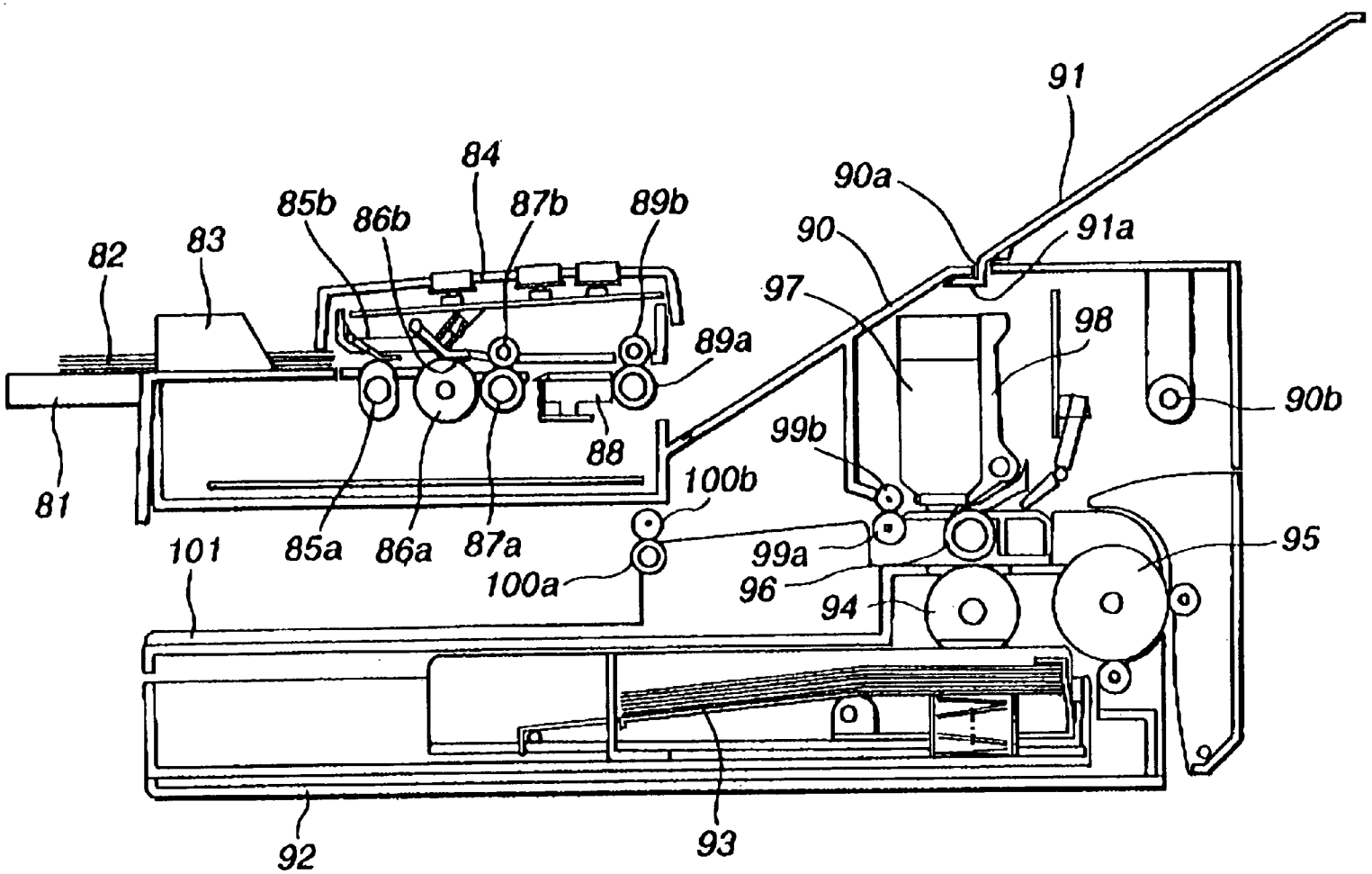
PRIOR ART FIG.10
FIG. 10 is a sectional view of a known facsimile apparatus.
Figure 11:
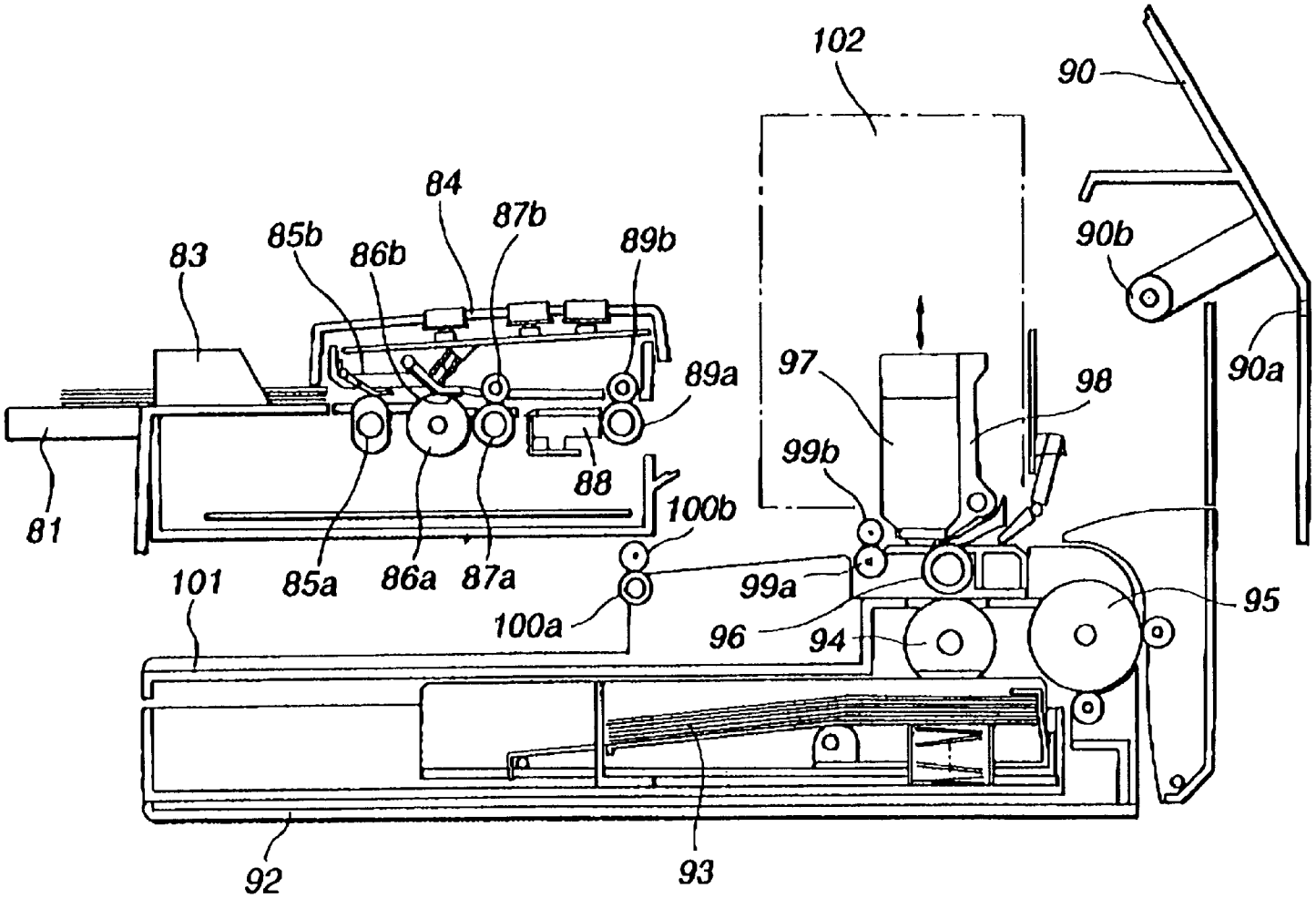
PRIOR ART FIG.11
FIG. 11 is a view explaining an operation to replace an ink jet cartridge in the facsimile apparatus of FIG. 10.

FIG. 9 is the enlarged view of the operational panel 65. The keys on the operational panel 65, including the cartridge replacement key 65*a*, are within an area 65*c*. In the first two embodiments noted above, return movement to the carriage waiting position L is performed by pressing the cartridge replacement key 65*a*. However, the control section can be constructed so that instead of using the cartridge replacement key 65*a* for such return movement, it is performed by pressing any other key in the area 65*c* on the operational panel 65.

As mentioned above, the replacement of ink jet recording means such as an ink jet cartridge is made easy with the above embodiments. The ink jet recording means can be returned to the waiting position easily and with certainty after replacement, so that its operational performance can be improved and the quality of the recording operation can be maintained.

Figure 12:
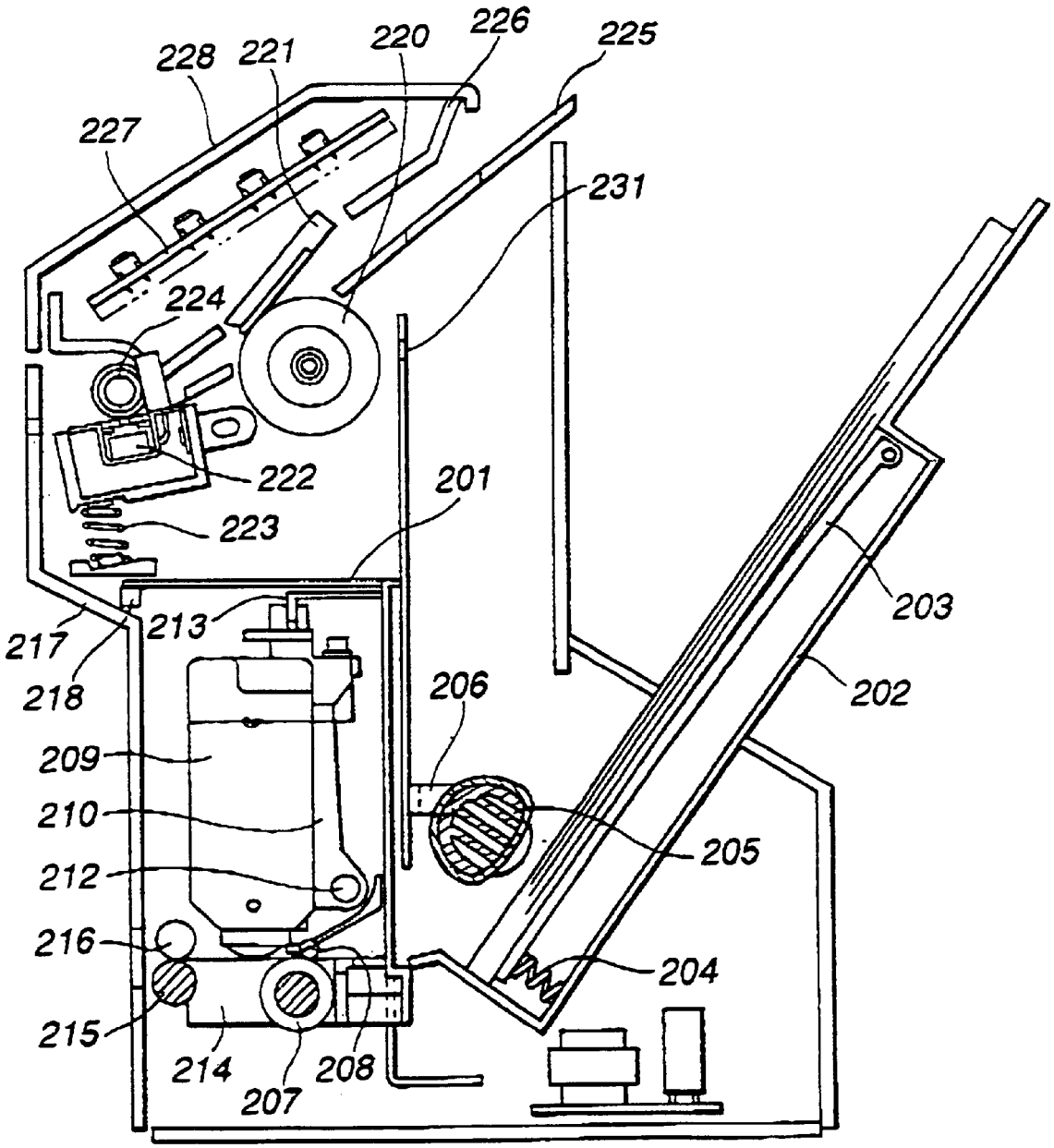
FIG. 12 is a sectional view of a facsimile apparatus incorporating another embodiment of the present invention.

FIG. 12 is a sectional view showing a facsimile apparatus with an ink jet recording section in accordance with another embodiment of the present invention.

The recording section of the facsimile apparatus includes a frame 201, that is, a main structure of whole apparatus and an ASF (Auto Sheet Feeder) chassis 202 fixed on the frame 201. The ASF chassis 202 provides an ASF section which loads two or more sheets of recording paper and feeds them individually to a recording section during a recording operation. A board 203 is rotatably attached to the ASF chassis 202 and is biased by the board pressing spring 204 in a clockwise direction. A recording paper separating roller 205 is rotated clockwise by a drive system (not shown) and a transmission type sensor 206 (roller position sensor) detects a home position of a recording paper separating roller 205.

A position of the board 203 shown in FIG. 12 corresponds to a waiting state wherein the board 203 stops rotating by a board movement control cam (not shown).

A first paper feed roller is 207 is rotated counterclockwise by the drive system, and a second paper feed roller 208 urged into contact with a periphery of the first paper feed roller 207 by a spring (not shown). The recording paper is held and fed by the contact portions of the first paper feed 10 roller 207 and the second paper feed roller 208 to the left (the sub-scanning direction). A recording head 209 has an ink jet head portion and a detachable ink cartridge to hold ink. The recording head 209 is detachably mounted on a carriage 210. A temperature sensor detecting temperature of the head portion is provided on the recording head 209.

A recording surface of the recording head 209 is at a lower part of the recording head 209. The head recording surface is formed by arranging plural nozzles in the horizontal direction. While moving the recording head 209 in a main scanning direction, which is perpendicular to the nozzle arrangement direction, during a recording operation, ink is selectively discharged from nozzles, to record a certain recording width on the paper. Afterward, the recording paper is fed in the sub-scanning direction a distance corresponding to the recording width, and the recording operation is repeated, until recording is performed on the entire recording paper.

A reflective-type photosensor is attached to the carriage 210 to detect the ink remaining quantity in the ink cartridge within the recording head 209 so that when the ink cartridge is empty, it can be replaced. A detecting direction of the sensor is roughly the same direction as the main scanning direction of the recording head 209. Since the sensor is attached to the carriage 210, it moves with the recording head 209 as the carriage 210 is scanned.

A first guide rail 212 and a second guide rail 213 assist the carriage to move smoothly in the main scanning direction. The carriage 210 is attached to these rails 212 and 213 so as to move in the main scanning direction, whereby the carriage 210 is moved bidirectionally by the drive system. A platen 214 faces the recording head and guides the recording paper so it faces the recording head, while maintaining a proper distance between the recording paper and the recording head. A second discharge roller 216 is biased toward a first discharge roller 215 by a pressing member (not shown).

The recording paper is held between the contact portion of the first discharge roller 215 and the second discharge roller 216, so that the recording paper is thereby discharged. A recording section cover 217 is structured to be opened at a lower fulcrum for a replacement of the ink cartridge of the recording head 209. A recording section cover sensor 218 detects whether the cover 217 is opened. An output signal of the sensor 218 is input to a control board 231 of a main section.

A separation roller 220 is rotated counterclockwise by the drive system and feeds plural originals sheet-by-sheet in the left-hand direction as seen in FIG. 12. A separating member 221 is biased toward the separation roller 220 by a pressing member, to separate plural originals and feed them sheet-by-sheet, and is made from high frictional material such as gum. A contact-type line image sensor 222 reads an image formed on the original to convert the information presented by the image into an electric signal. A CS roller 224 is rotated clockwise by the drive system. A CS spring 223 presses the image sensor 222 toward the CS roller 224. The CS roller 224 urges the original into close contact to the entire reading surface of the image sensor 222, it feeds the original to the left and it is white to provide a background for the original being read.

A bottom original guide 225 is fixed to the frame 201 supporting a reading section and an operational section. The guide 225 contacts a bottom surface of the original. An upper original guide 226 is fixed to the bottom original guide 225 to guide an upper surface of the original. A operation board 227 includes an operation switch. An operation section 228 holds the operation board 227 and is fixed to the bottom original guide 225.

A power supply section includes a power supply transformer, a condenser and so on. A control board 231 is attached to the frame 201 and controls the operation of whole apparatus.

To the control board 231 are connected lines from the various electrical elements and parts of the apparatus (the image sensor 222, the operation board 227, the power supply section, the recording head 209, drive motors (not shown), the various sensors, and so on). In addition, the reading section may include other sensors, such as a sensor for detecting the existence/absence of recording paper, are also provided on the control board 231. In addition, interfaces (for example, a public telephone line interface, an extension telephone interface, an outside extension telephone interface, a Centronics interface to connect to a personal computer) are connected to the control board 231.

Figure 13:
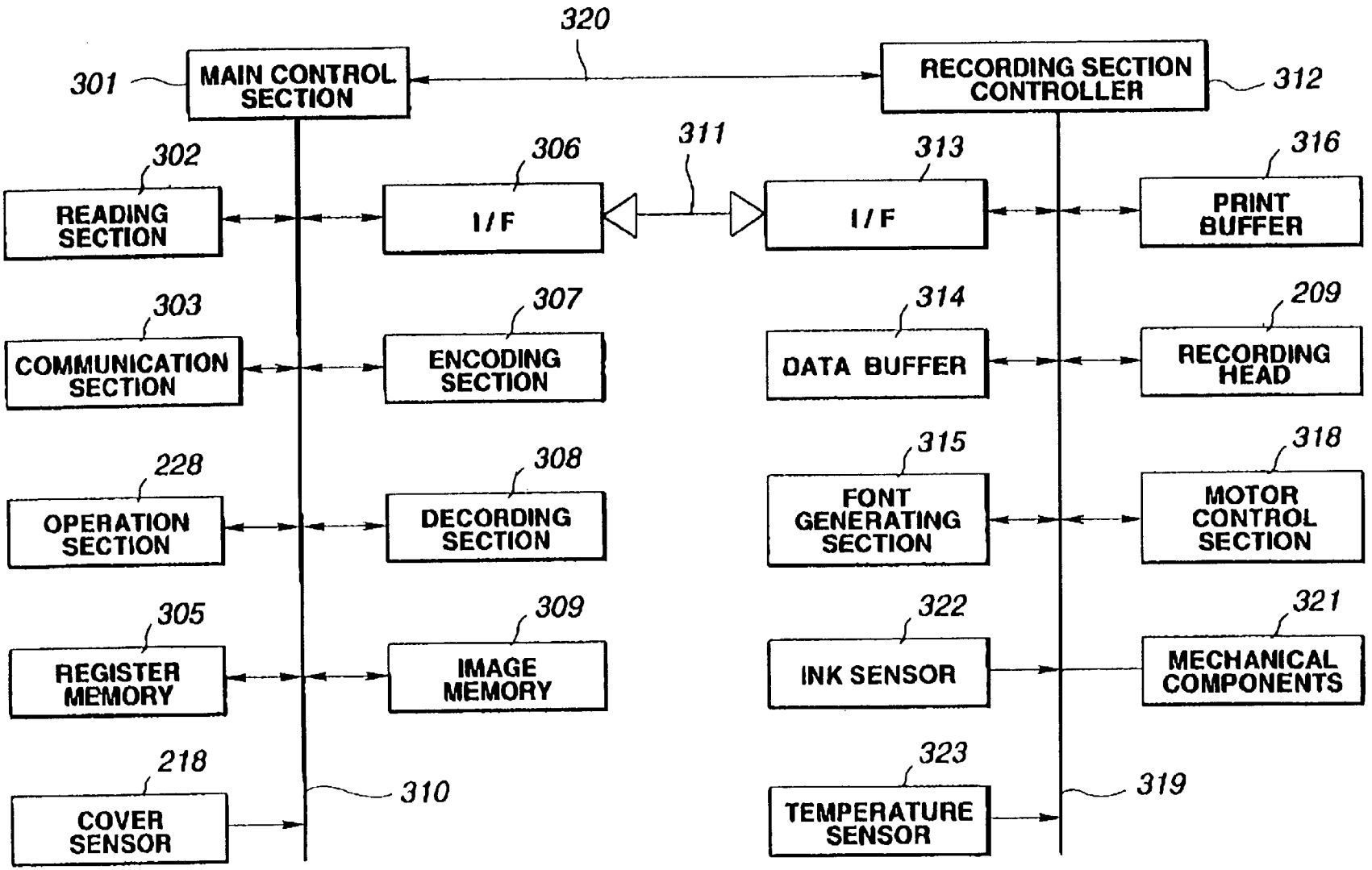
FIG. 13 is a block diagram of the facsimile apparatus of FIG. 12.

FIG. 13 is a block diagram of the facsimile apparatus, which is roughly divided into two parts. One part is a main section performing basic facsimile operations such as communication, reading and encoding/decoding of data. The control board 231 is part of the main section. The other part is a printing section that receives recording data from the control board 231 and performs recording.

A main control section 301 controls operation of the main section. The main control section 301 provides an MPU, such as a microprocessor, a ROM for storing a control program for the MPU and data, a RAM used as a work area for temporarily storing data during processing by the MPU. A reading section 302 reads originals optically and converts an original image into an electric signal. A communication section 303 connects and disconnects calls, modulates transmitted data and demodulates received data, to provide data communication with other facsimile apparatus through a telephone line. An operation section 228 provides an operation key that is operated by a user and an indicator such as a liquid crystal display. A register memory 305 stores telephone number data to provide functions such as automatic dialing and maintaining communication log information.

A main section interface (I/F) 306 controls communication between the printing section and the main section. A decoding section 307 decodes coded image data and an encoding section 308 codes image data. An image memory 309 stores received image data and image data is read out by a reading section 302. A main system bus 310 connects the main control section 301 of the main section to each part mentioned above. An I/F signal line 311 connects the recording section with the main section. The interface may correspond to Centronics specifications and the RS232C specification.

A recording section controller 312 controls the recording section and its structure is similar to the main control section 301. A data buffer 314 temporarily stores print data from the main section received through the recording section I/F 313. A font generating section 315 generates font data corresponding to print data. A print buffer 316 stores raster data (print image data) before outputting it to the recording head 209. The recording head 209 records an image on the recording paper (media) by discharging ink droplets based on data from the print buffer 316.

A feed/discharge motor control section 318 controls a feed motor for the recording paper. A system bus 319 connects the recording section controller and each part of the recording section. A signal line 320 connects the main control section 301 and the recording section controller 312 and transmits serial signals. The recording section also contains numerous mechanical components 321, such as a carriage motor feeding the recording head 209 and a recovery mechanism of the recording head 209. An ink sensor 322 detects whether or not the ink cartridge is installed. A temperature sensor 323 detects the temperature of the recording head 209.

Figure 14:
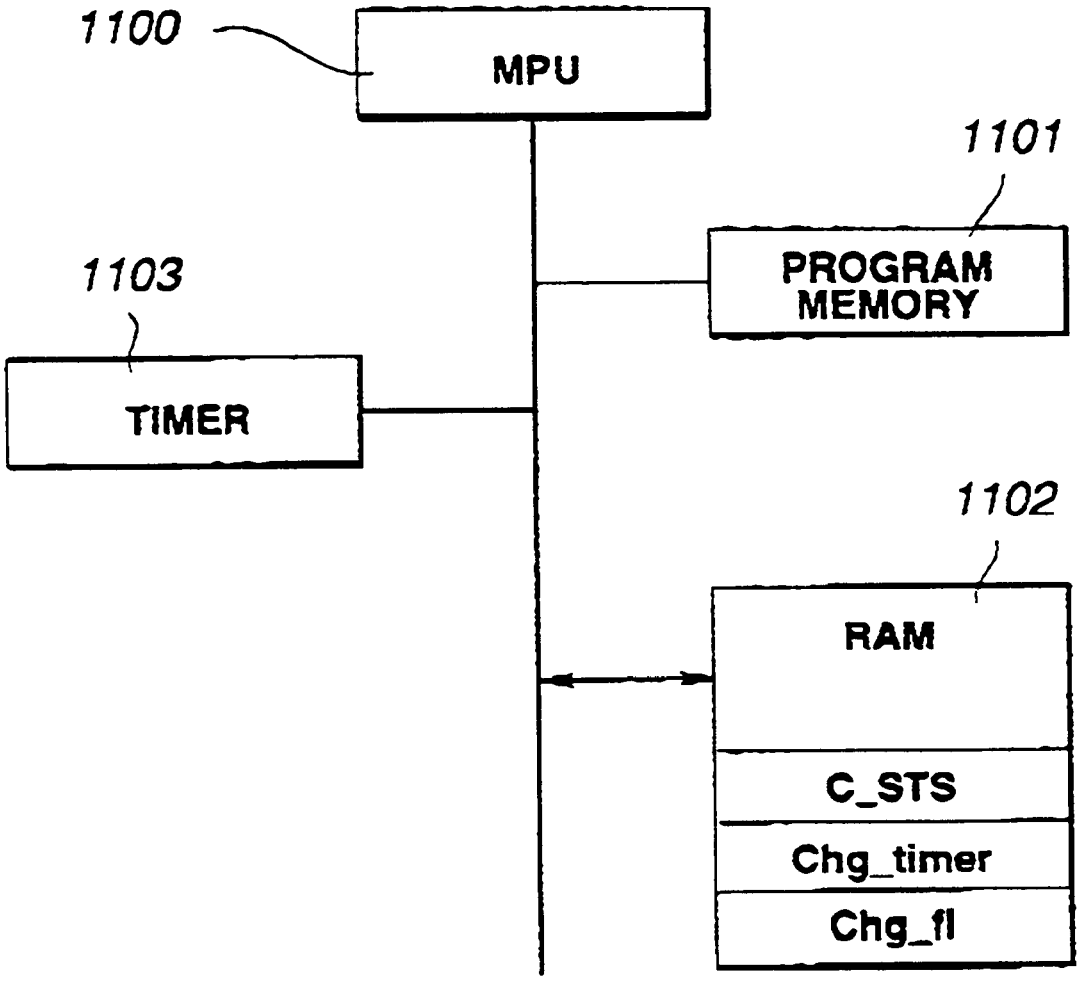
FIG. 14 is a block diagram showing of a main control section of the facsimile apparatus of FIG. 12.

FIG. 14 is the block diagram showing the structure of the main control section 301 of the main section.

An MPU comprises a microcomputer 1100, and a program memory 1101 (ROM) stores the control program carried out by the MPU 1100. A RAM 1102 stores cartridge-status (c_sts), elapsed time (chg_timer), and replacement flags (chg_fl).

Figure 15:
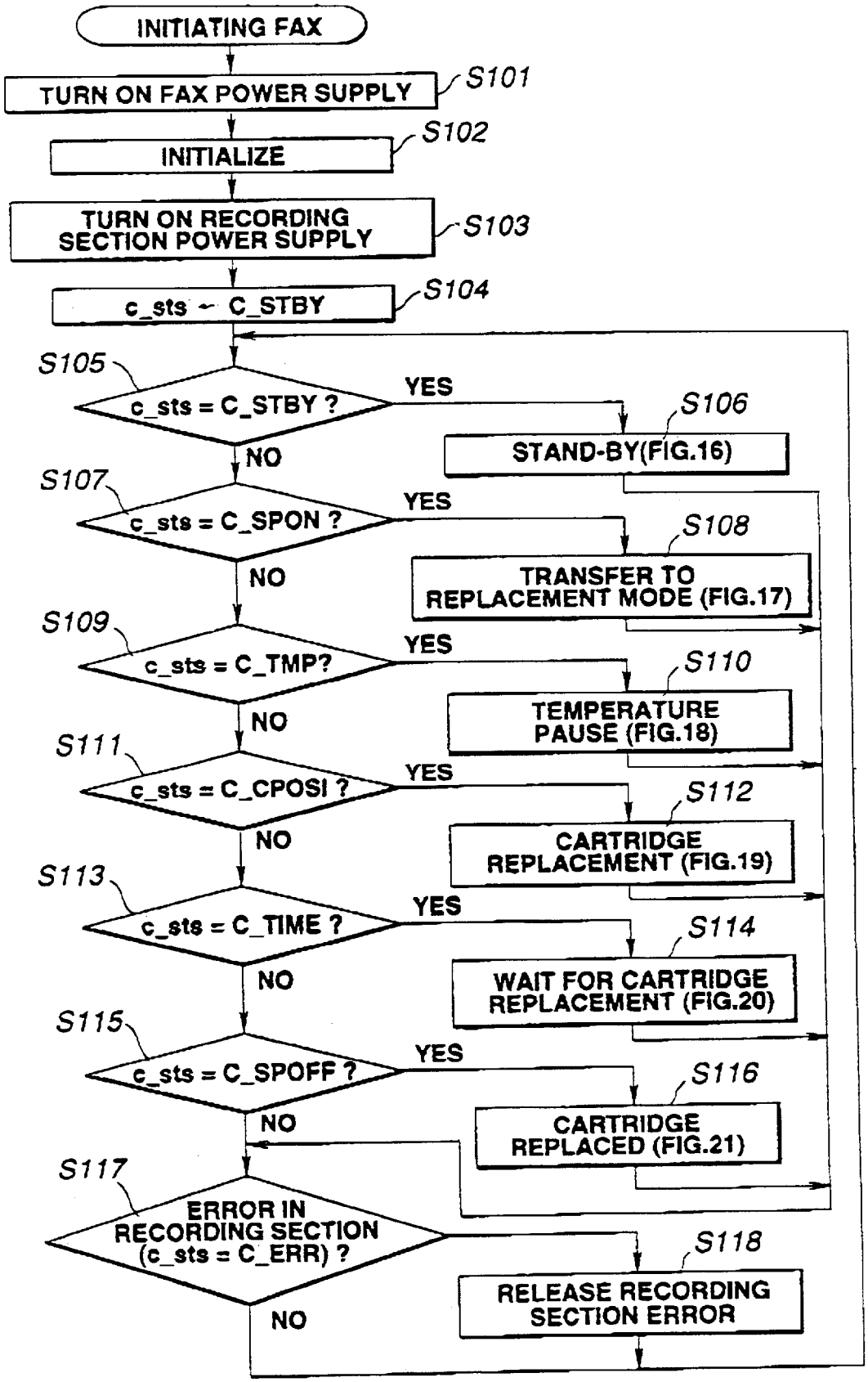
FIG. 15 is a general flow chart of an operation to replace an ink jet cartridge in the facsimile apparatus of FIG. 12.

FIG. 15 is a flow chart showing a cartridge replacement operation involving the recording section in the main section of the facsimile apparatus. This operation begins upon receipt of a facsimile signal.

In step S101 power is turned on by receipt of a facsimile signal by the facsimile apparatus. In step S102 the facsimile apparatus is initialized, and in step S103 power is supplied to the recording section. Control of the recording section by the recording section controller 312 will be explained below by referring the flow chart in FIG. 22.

In step S104, the cartridge-status flag c_sts, representing the condition of the cartridge in relation to the recording section, is set on C_STBY, meaning a stand-by condition for cartridge replacement.

In step S105 it is determined if the cartridge is in its stand-by condition (c_sts=C_STBY). If so, the process goes to step S106 to perform stand-by processing (explained below by referring to FIG. 16).

On the other hand, if the cartridge is not in the stand-by condition (c_sts≠C_STBY), the process goes to step S107. In step S107 it is determined whether the cartridge is in a replacement-permitted condition (c_sts=C_SPON). If so, the process goes to step S108. In step S108, the process enters the cartridge-replacement procedure (explained below by referring to FIG. 17).

If the cartridge is not in the replacement-permitted condition (c_sts≠C_SPON), the process goes to step S109. In step S109 it is determined if the cartridge is in an elevated-temperature condition (c_sts=C_TMP). This condition indicates that the temperature of the recording head is too high to permit cartridge replacement, and causes the process to go to step S110. In step S110 a pause procedure is followed to permit the temperature of the recording head 209 to fall to an acceptable level (explained below by referring to FIG. 18).

On the other hand, if the cartridge is not in an elevated-temperature condition (c_sts≠C_TMP), the process goes to step S111. In step S111 it is determined if the cartridge is in a replacement mode (c_sts=C_CPOSI); if so, the process goes to step S112. In step S112 a procedure is followed for replacement of the cartridge (explained in detail by referring to FIG. 19).

If the cartridge is not the cartridge-replacement mode (c_sts≠C_CPOSI), the process goes to step S113. In step S113, it is determined if the cartridge is in a replacement-pause condition (c_sts=C_TIME); if so, the process goes to step S114. In step S114, the replacement-pause operation is performed (explained below referring to FIG. 20).

If the cartridge is not the replacement-pause mode (c_sts≠C_TIME), the process goes to step S115. In step S115 it is determined if the cartridge is a replacement-end mode (c_sts=C_SPOFF); if so, the process goes to step S116. In step S116 a replacement-termination procedure is performed (explained below by referring to FIG. 21).

In step S115 if the cartridge is not in the replacement-termination mode, the process goes to step S117. The process also goes to step 117 after steps S106, S108, S110, S112, S114 and S116.

In step S117 it is determined if there is an error in the recording section (c_sts=C_ERR); if so, the process goes to step S118. In step S118 a process releasing the error condition in the recording section is performed. When the error is released, the cartridge-status flag (c_sts) is set to the stand-by condition (C_STBY) and the process returns to step S105. If a error is not detected in step S117, the process goes directly to step S105. Subsequently, steps S105 to S118 are repeated until power to the apparatus is turned off.

Figure 16:
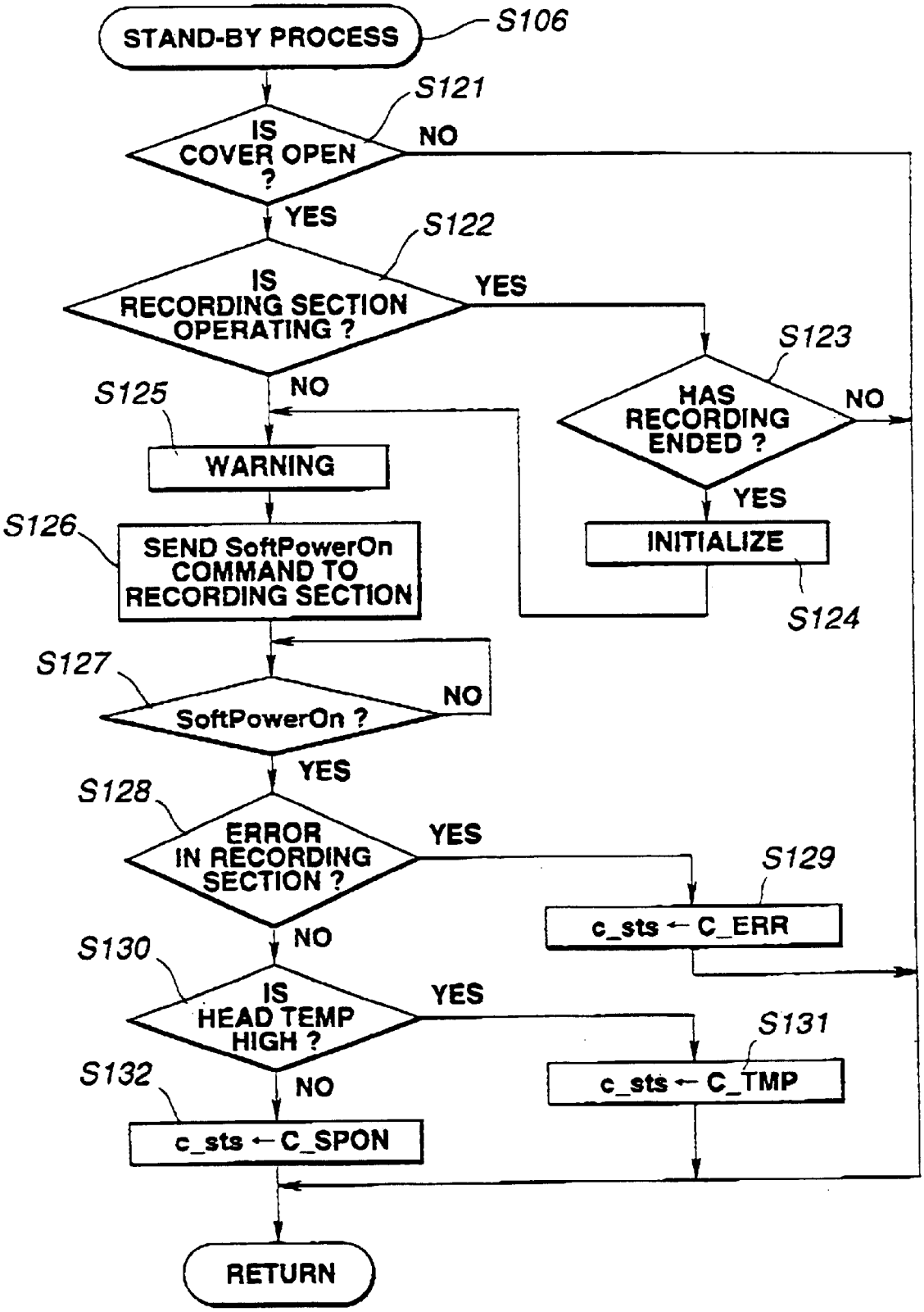
FIGS. 16 to 21 are flow charts of components of the cartridge replacement operation depicted in FIG. 15.

FIG. 16 is the flow chart showing the stand-by procedure represented by step S106 of FIG. 15.

In step S121 it is determined if the cover 217 of the recording section is open, by detecting a signal from the recording section cover sensor 218. If the cover is closed, the stand-by process is terminated and the process goes to step S117 in the flow chart of FIG. 15.

If the cover 217 is open, the process goes to step S122. In S122 it is determined if the recording section is in operation by a signal between the recording section and the recording section controller 312 through the line 320. If so, the process goes to step S123, where it is determined if operation of the recording section is to be terminated; if so, the process goes to step S124. (If not, the stand-by procedure is terminated and control goes to step 117 in FIG. 15.) In step S124 operation of the recording section is terminated and the recording section is initialized, after which the process goes to step S125. In step S122, if the recording section is not in operation, the process goes directly to step S125.

In step S125 the operation section 228 indicates movement of the ink cartridge. If the cartridge is still moving, audible and visible alarms are sounded until the cartridge comes to rest. The process then goes to step S126, where a SoftPowerOn command is generated by the main control section 301 (on control board 231) and transmitted through the signal line 320 to the recording section. Step S127 monitors whether or not the recording section has shifted to the SoftPowerOn condition. When notification of completion of the transition to that condition is received through the signal line 320, the process goes to step S128.

Figure 22:
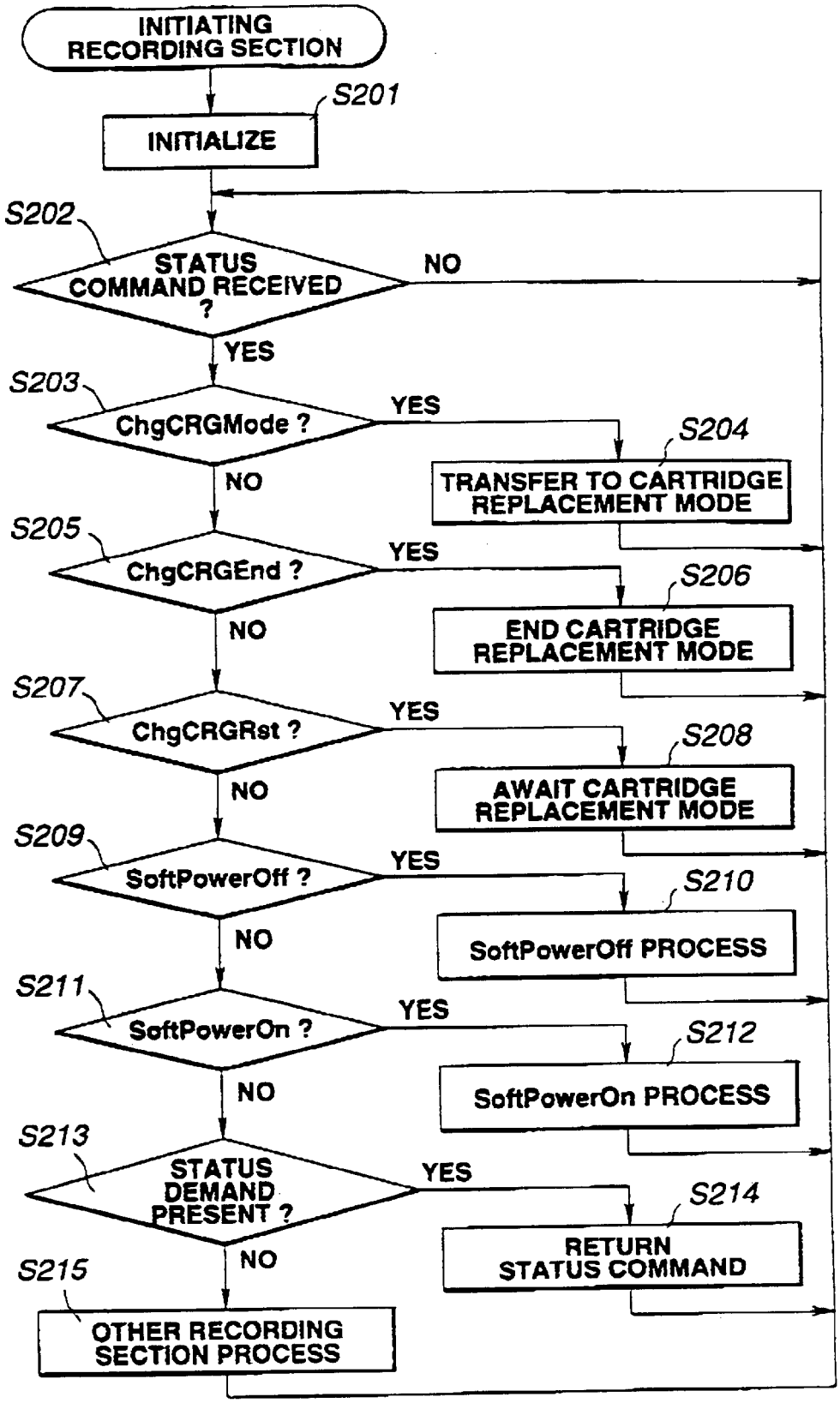
FIG. 22 is a flow chart of the operation of a recording section of the facsimile apparatus of FIG. 12 during a cartridge replacement operation.

During monitoring of the transitional condition of the recording section, a status demand command is transmitted to the recording section from the main control section through the signal line 320, and a status return signal is transmitted to the main section from the recording section in response to the status demand command, as explained by referring to FIG. 22. From the response, the main control section can recognize the condition of the recording section. Although omitted from these flow charts for the sake of clarity, status demands and status return are carried out regularly, so that the main control section can determine the status of the recording section and the steps in the flow charts described herein can be performed.

In any event step S128 determines if the recording section is in an error state; if so, the process goes to step S129. In step S129, the cartridge status flag is set to so indicate (c_sts=C_ERR) and the stand-by process is terminated.

On the other hand, if the recording section is not in a error state, the process goes to step S130. In step S130, it is determined if the temperature of the recording head 209 is too high, based on the signal from the temperature sensor 323 of the recording head 209. If so, the process goes to step S131, where the cartridge-status flag (c_sts) is set to the elevated-temperature condition (C_TMP), meaning that the recording head 209 is in a high-temperature condition, whereby the stand-by process is terminated. Details regarding the elevated-temperature condition (C_TMP) will be explained later by referring to the flow chart shown in FIG. 18.

If the temperature of the recording head 209 is not elevated, the process goes to step S132. In step S132 the cartridge-status flag (c_sts) is set to the replacement-permitted condition (C_SPON), meaning that the cartridge replacement mode is available in the recording section, whereby the stand-by process is terminated. Details regarding the replacement-permitted mode (C_SPON) will be explained by referring to the flow chart shown in FIG. 17.

Figure 17:
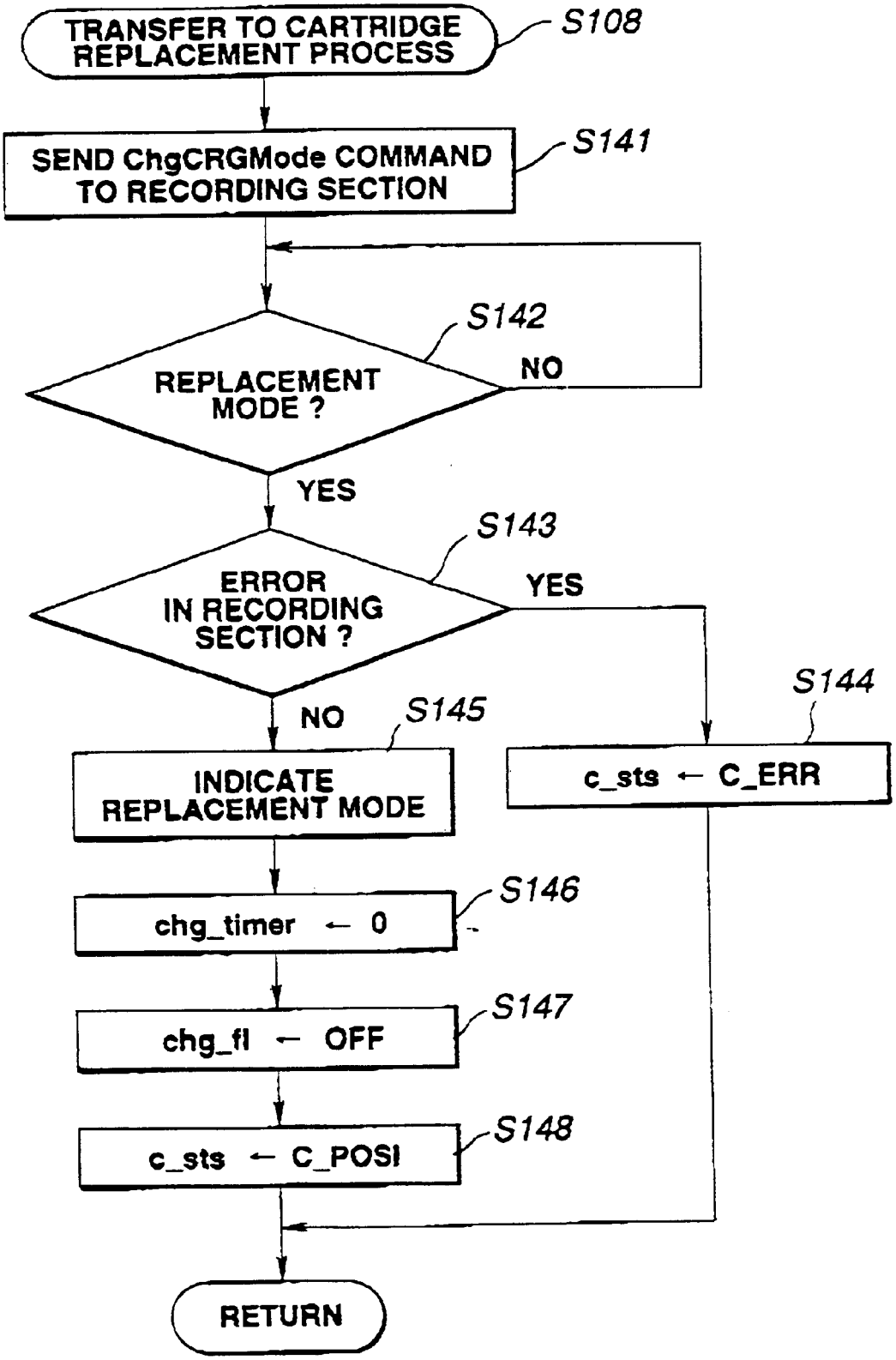

FIG. 17 illustrates how the process is transferred to the replacement mode (step S108 in FIG. 15). When c_sts=C_SPON, the transfer is carried out.

In step S141 a change-cartridge command (ChgCRGMode), shifting the recording section to the cartridge-replacement mode, is sent to the recording section from the main section through the signal line 320. Thereby, the carriage moves to the replacement position M. Step S142 monitors whether the cartridge has transferred to the cartridge replacement position. When the transfer is complete, the process goes to step S143. In step S143, it is determined if the recording section is in an error state; if so, the process goes to step S144. In step S144, c_sts is set to C_ERR, meaning that the recording section is an error state and transfer to the cartridge replacement mode is terminated.

On the other hand, if the recording section is not in an error state, the process goes to step S145. In step S145, the operation section 228 indicates that the recording section shifts to the cartridge replacement mode (step S204 of FIG. 20). In step S146 the Chg_timer flag, showing the elapsed time after transition to the cartridge replacement mode, is initialized to "0". The Chg_timer flag is incremented based on the time by the timer 1103.

In step S147 a flag (Chg_fl), indicating whether the cartridge has been replaced in the recording section, is set to OFF. In step S148 the cartridge-status flag (c_sts) is set to C_CPOSI, meaning that the process is ready for the cartridge-replacement mode. Details of regarding the condition represented by c_sts=C_CPOSI will be explained later by referring to the flow chart shown in FIG. 19.

Figure 18:
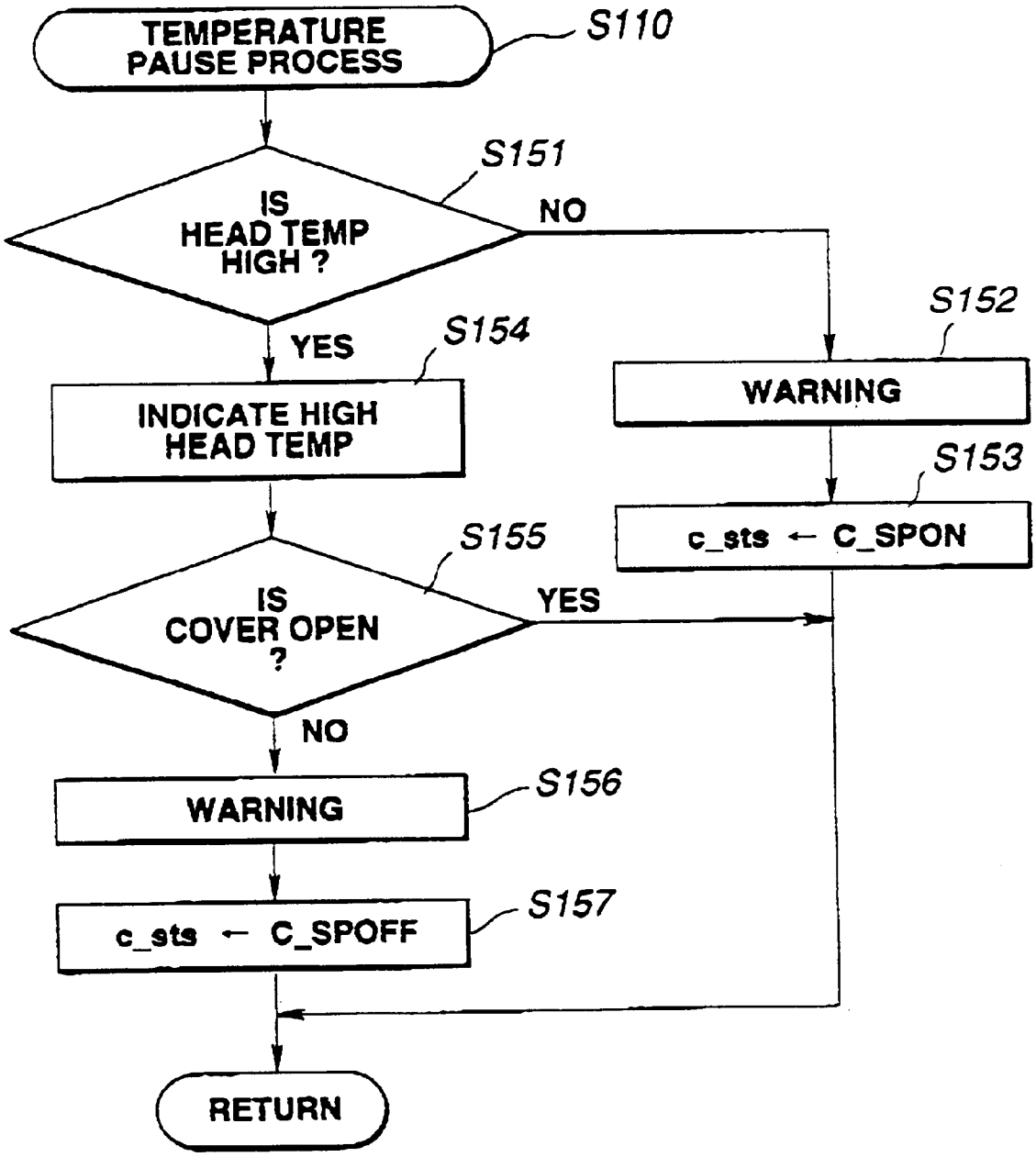

FIG. 18 shows the head temperature waiting process of step S110 of FIG. 15, which is performed when the cartridge-status flag (c_sts) is set to the flag (C_TMP).

In step S151, it is confirmed if the temperature of the recording head 209 is too high by the signal from temperature sensor 323. If not, the process goes to step S152. In step S152, the operation section 228 checks to see if the recording head 209 is moving and if so sounds an alarm. Once the recording head has reached the replacement position M, the process goes to step S153. The cartridge-status (c_sts) is set to C_SPON, meaning that the process is in the transfer-permitted condition and the temperature waiting process is terminated. Accordingly, transition to the cartridge replacement mode is prohibited if the temperature of the recording head 209 is too high to allow it to be safely handled.

According to step S151, if the temperature of the recording head 209 is too high, the process goes to step S154. In step S154, the operation section 228 indicates that the temperature of the recording head 209 is elevated. Step S155 determines if the cover 217 of the recording section is open state; if so, the process of waiting for the head temperature to fall is terminated.

If the cover 217 of the recording section is closed, the process goes to step S156. In step S156, the operation section 228 checks for movement of the recording head 209 and the cartridge reaches the replacement position. In step S157, the cartridge-status flag (c_sts) is set to C_SPOFF and the process returns to FIG. 15. Details regarding the condition represented by c_sts=C_SPOFF will be explained later by referring to the flow chart shown in FIG. 21.

Figure 19:
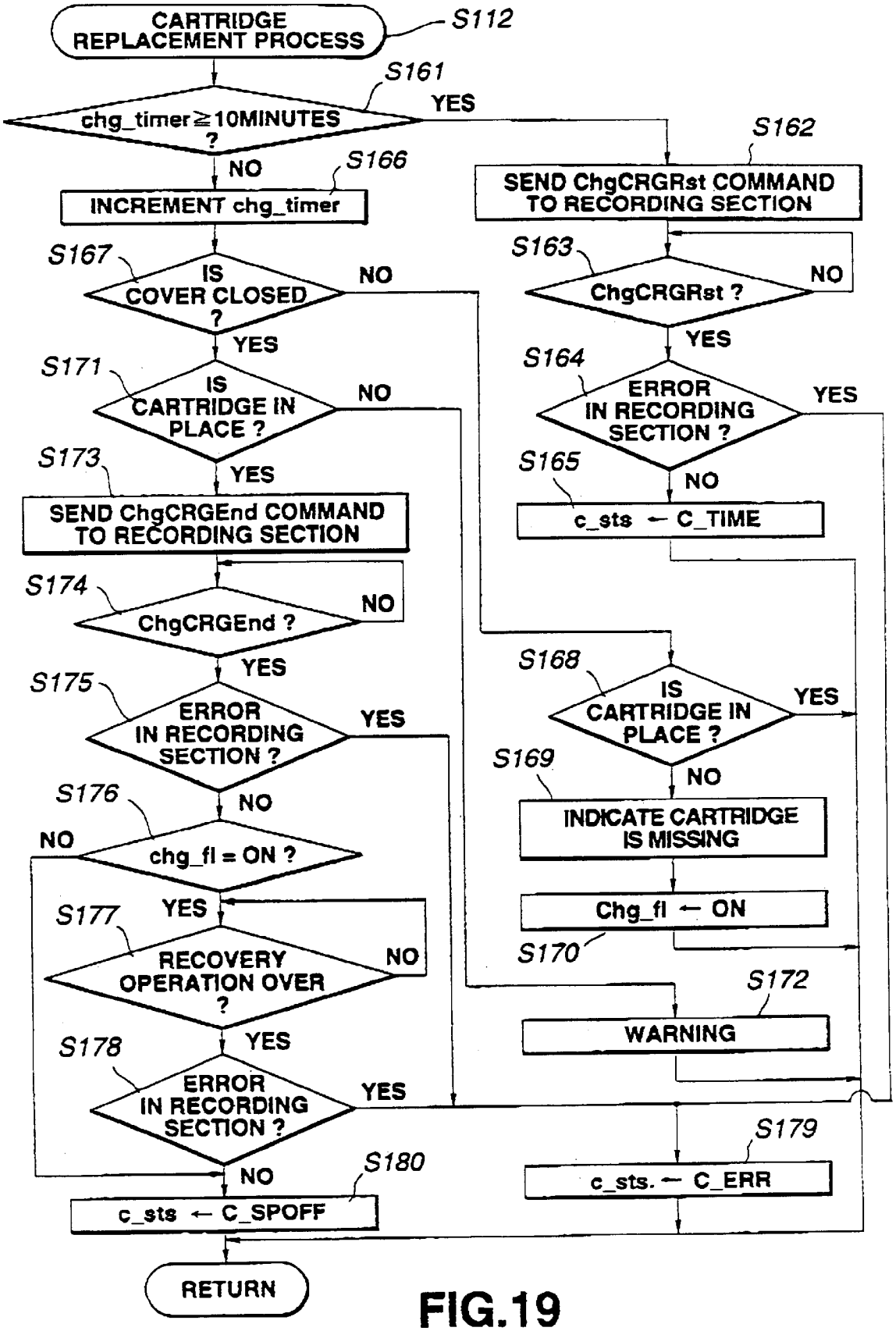

FIG. 19 shows the procedure following when the cartridge-status flag c_sts shown in step S112 of FIG. 15 is set to C_CPOSI, meaning that the cartridge can be replaced.

In step S161, it is confirmed if the value of the chg_timer showing the elapsed time after transition to the replacement mode of the cartridge is more than ten minutes. If so, the process goes to step S162. In step S162, a change-cartridge rest command (ChgCRGRst) to shift the recording section to the cartridge replacement-waiting mode is transmitted to the recording section from the main section through the signal line 320. In step S163, it is monitored whether the recording section completed a transition to the cartridge replacement-waiting mode. The process waits until the transition is completed and then goes to step S164.

In step S164, it is confirmed whether the recording section is in an error state; if so, the process goes to step S179. In step S179, the cartridge-status flag c_sts is set to C_ERR. If not, the process goes to step S165. In step S165, the cartridge-status flag c_sts is set to C_TIME, meaning that the process is in the cartridge replacement-waiting condition, and the cartridge replacement mode is terminated. The details of the mode represented by c_sts=C_TIME will be explained by referring to the flow chart shown in FIG. 20.

In step S161, if the count value of the chg_timer is less than ten minutes, the process goes to step S166. In step S166, the count value of the chg_timer is incremented by the elapsed time (as the timer 1103 counts). In step S167, it is confirmed whether the cover 217 of the recording section is closed and if not, the process goes to step S168. In step S168, it is determined if the cartridge is replaced (by the ink sensor 322) and, if the cartridge is installed (that is, not replaced), the process of cartridge replacement is terminated. On the other hand, if the cartridge is determined in step S168 to have been removed, the process goes to step S169. In step S169, the operation section 228 indicates the absence of the cartridge.

In step S170, the chg_fl flag showing whether the cartridge is replaced is turned ON because absence of the cartridge means that it can be replaced; the cartridge replacement process is then terminated. The presence or absence of the cartridge can be detected by determining if the connection between electrodes of the carriage and the recording head is ON or OFF. If there is no connection between the electrodes for longer than predetermined time (0.6 second), it is assumed that the cartridge is not in place.

In step S167, if the cover 217 of the recording section is closed, the process goes to step S171. In step S171, it is confirmed whether the cartridge is installed as in step S168 and, if not, the process goes to step S172. In step S172, after a warning sound showing that the cartridge is removed is generated, the cartridge replacement process is terminated.

In step S171, if the cartridge is installed, the process goes to step S173. In step S173, a change cartridge end command (ChgCRGEnd) to terminate the cartridge replacement process is sent to the recording section from the main section through the signal line 320. The recording section then returns to the waiting position L. In step S174, it is monitored whether the cartridge replacement process has been terminated in the recording section, and this step waits until the termination is completed. When the cartridge replacement mode is terminated, the process goes to step S175.

In step S175, it is determined if there is an error in the recording section; if so, the process goes to step S179. In step S179, the cartridge-status flag c_sts is set to C_ERR, showing that the recording section is in an error condition. If not, the process goes to step S176. In step S176, it is determined if the chg_fl flag is ON, that is, if the cartridge is replaced. If chg_fl is OFF (the cartridge is not replaced), the process goes to step S180. If chg_fl is ON (the cartridge is replaced), the process goes to step S177. In step S177, it is monitored whether the recording section has completed a recovery operation, and the step waits until the recovery operation is completed. The process then goes to step S178. In other words, in the case where the cartridge is replaced, favorable printing conditions can be maintained since a recovery process is carried out, but if the cartridge is not replaced, ink is not consumed since the recovery process is not performed.

In step S178, it is determined if the recording section is in an error condition through the signal line 120, if so, the process goes to step S179. In step S179, the cartridge-status flag c_sts is set to C_ERR, and the cartridge replacement process is terminated. If not so in step S178, the process goes to step S180. In step S180, the cartridge-status flag c_sts is set to C_SPOFF, and cartridge replacement process is terminated.

Figure 20:
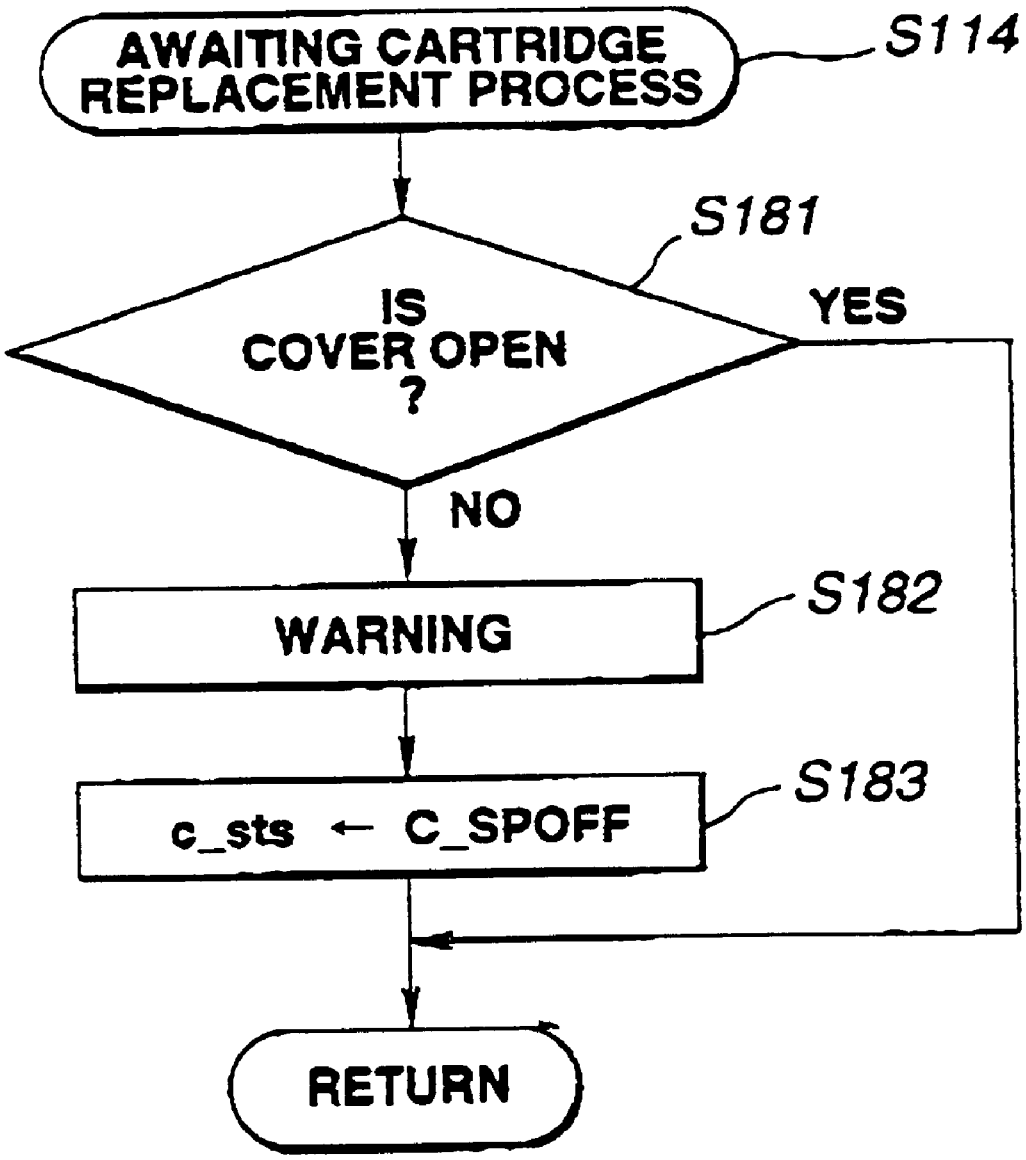

FIG. 20 is a flow chart showing the cartridge replacement pause mode in step S114 of FIG. 15. It is performed when the cartridge-status flag c_sts is set to C_TIME.

In step S181, it is determined if the cover 217 of the recording section is open; if so, the cartridge replacement pause mode is terminated. On the other hand, if the cover 217 is closed the process goes to step S182. In step S182, the operation section 228 indicates movement of the recording head 209 if so and a warning is sounded. In step S183, the cartridge-status flag c_sts is set to C_SPOFF showing that the cartridge replacement pause process is complete and the process is terminated.

Figure 21:
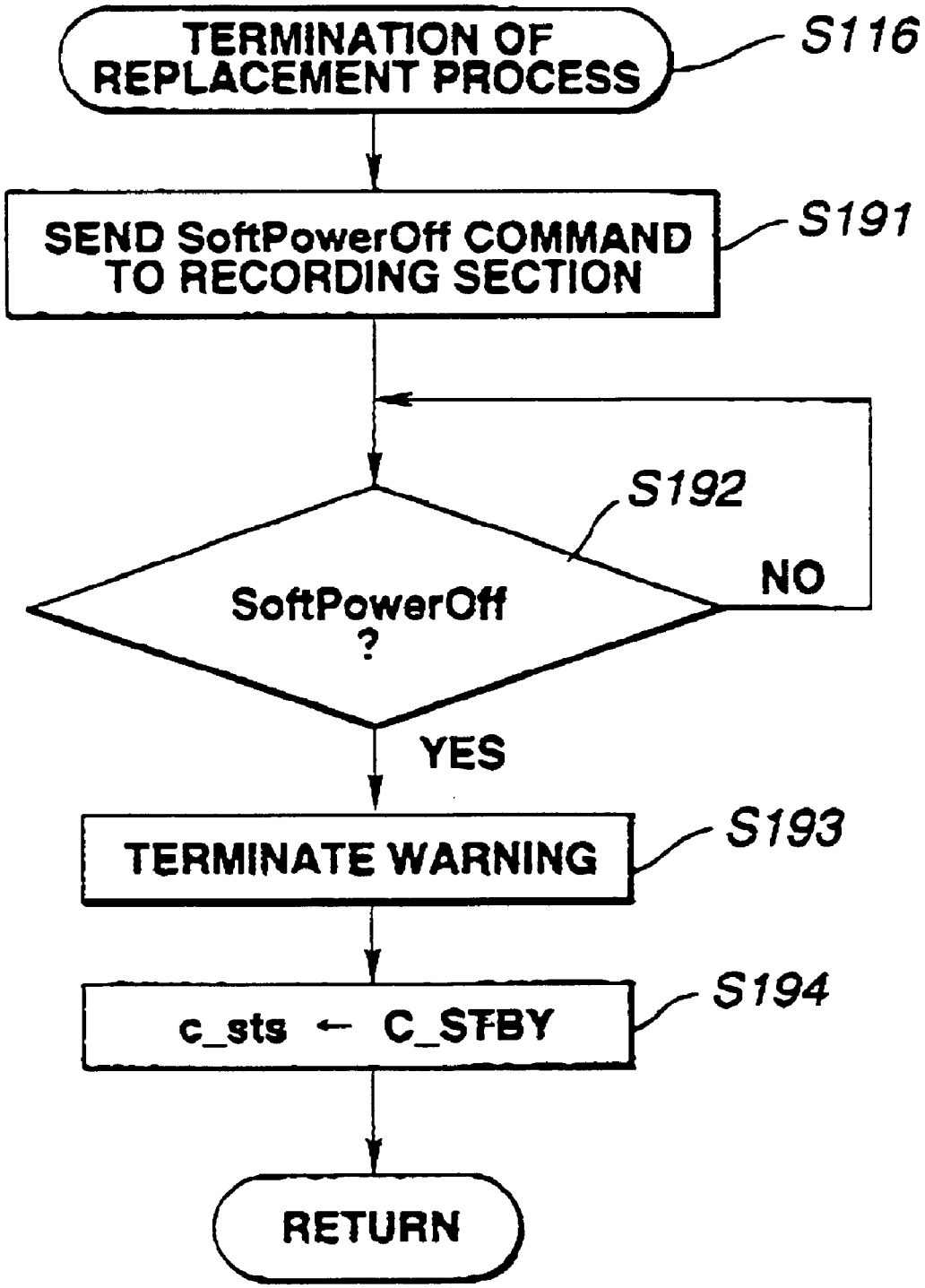

FIG. 21 is a flow chart showing the cartridge replacement end process in step S116 of FIG. 15 and is performed when the cartridge-status flag c_sts is set to C_SPOFF.

In step S191, a command (SoftPowerOff) for shifting the recording section to the waiting condition is sent to the recording section from the main section through the signal line 320. In the soft power OFF condition, electric power is supplied to the controller 312, the interface section 313, a buffer and so on, but not to the mechanical components 321 of the recording section. In step S192, it is determined if the recording section is in the soft power OFF condition, and the step waits until the transition is completed. The process then goes to step S193.

In the step waiting for confirmation of the soft power OFF condition, if there is no command concerning recording in a predetermined time, the main control section 301 issues an ESS (Energy Save Stand-by) command to shift to a power saving mode. In the power saving mode, electric power is not supplied to any of the controller 312, the interface, the buffer, as well as the mechanical components of the recording section. For this reason, power consumption will be even less in the power saving mode than in the waiting condition defined by the soft power OFF command. In the power saving mode, the main control section 301 maintains the timer controlled by the recording section side and the other conditions, and before the recording section returns to a recording mode or to the waiting condition from the power saving mode, the main control section 301 sends the count value of the timer and various conditions to the recording section.

In the waiting condition the state of the recording section is monitored regularly (every 30 milliseconds), and if the apparatus is an error condition, it does not shift to the power saving mode even though there is no command in a predetermined time. This is because it is preferred that such errors be detected as soon as possible.

In step S193, the operation section 228 indicates the termination of movement of the carriage to the waiting position. In step S183, the cartridge-status c_sts is set to C_SPOFF, showing that the cartridge replacement process is the stand-by condition.

FIG. 22 is a flow chart showing how the cartridge replacement process operates the recording section of the facsimile apparatus.

This process commences by turning on the power supply of the recording section in step S101 of FIG. 15. In step S201, the recording section is initialized. In step S202, it is confirmed whether a status command is received from the main section through the signal line 320; if not, the process returns to step S202.

When a command is received in step S202, the process goes to step S203. In step S203, it is determined whether the ChgCRGMode command is present, shifting the process to the cartridge replacement mode; if so, the process goes to step S204. In step S204, a process transferring to the cartridge replacement mode is carried out and the process returns to step S202.

On the other hand, if that command is not present, the process goes to step S205. In step S205, it is determined whether the ChgCRGEnd command is present, ending the cartridge replacement process; if so, the process goes to step S206. In step S206, cartridge replacement termination is carried out and the process returns to step S202.

In step S205, if the ChgCRGEnd command is not present, the process goes to step S207. In step S207, it is determined whether the ChgCRGRst command is present, causing the cartridge replacement process to "rest"; if so, the process goes to step S208. In step S208, the cartridge replacement operation is paused, and the process returns to step S202.

In step S207, if the ChgCRGRst command is not present, the process goes to step S209. In step S209, it is determined whether the received command is a command SoftPowerOff command, shifting to a soft power OFF condition; if so, the process goes to step S210. In step S210, a soft power OFF condition is established and the process returns to step S202. This transfer includes terminating power supply to the recording head 209 and the mechanical components 321 of the recording section.

In step S209, if the received command is not the SoftPowerOff command, the process goes to step S211. In step S211, it is determined whether the received command is the SoftPowerOn command, shifting to a soft power ON condition; if so, the process goes to step S212. In step S212, transfer to a soft power ON condition is carried out and the process returns to step S202. The operations involved in initialization, such as the recovery process (including suction of ink in the recording head 209), any head-tracking correcting process and so on, are carried out at the time the soft power ON condition is established.

In step S211, if the received command is not the SoftPowerOn command, the process goes to step S213. In step S213, it is determined whether the received command is a status demand command; if so, the process goes to step S214. In step S214, the status demand is returned to the main section through the signal line 320 and the process returns to step S202. By this status demand, the main section (main control section 301) can determine whether or not each of the recording section commands is present.

In step S213, if the received command is not the status demand command, the process goes to step S215. In step S215, the main section is informed that the received command is an unrecognized command which is not defined and the process returns to step S202.

According to this embodiment if the cover of the recording section is open, the recording section is automatically placed in the cartridge replacement mode, and if the cover is closed, the cartridge replacement mode is automatically terminated. Thus, it is easy for the operator to replace the cartridge. If the temperature of the cartridge is too high, the transition to the cartridge replacement mode is prohibited, even though the cover is open, so that injury to a user can be prevented.

Moreover, when the cover is closed after being open, the cartridge the replacement mode is released automatically and the cartridge is returned to the stand-by condition, wherein the recording head can be capped. Therefore, faulty ink discharge caused by ink adherence can be prevented. Moreover, a user can replace the cartridge with little trouble.

Typical structures and operational principles of devices to which the present invention can be applied are preferably those disclosed in U.S. Pat. Nos. 4,723,129 and 4,740,796. Those principles and structures are applicable to a so-called on-demand type recording system and to a continuous type recording system, but are particularly suitable to the on-demand type. Such an approach adopts the principle that at least one driving signal is applied to an electrothermal transducer disposed on a liquid (ink) retaining sheet or in a liquid passage, the driving signal being sufficient to provide a quick temperature rise beyond a departure-from-nucleation boiling point. The thermal energy provided by the electrothermal transducer produces film boiling on the heating portion of the recording head, whereby a bubble can be formed in the liquid (ink), in response to each driving signal. The production, development and contraction of the bubble causes ejection of the liquid (ink) through an ejection outlet to produce at least one droplet. The driving signal is preferably in the form of a pulse, because this enables the development and contraction of the bubble to be effected instantaneously, and therefore, the liquid (ink) is ejected with quick response to the driving signal. The pulse-shaped driving signal is preferably formed as disclosed in U.S. Pat. Nos. 4,463,359 and 4,345,262. In addition, the rate of temperature increase of the heating surface is preferably such as disclosed in U.S. Pat. No. 4,313,124.

The structure of the recording head may be as shown in U.S. Pat. Nos. 4,558,333 and 4,459,600, wherein the heating portion is disposed at a bent portion of a liquid flow path, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670, wherein a common slit is used as the ejection outlet for plural electrothermal transducers, and to the structure disclosed in Japanese Laid-Open Patent Application No. 59-138461, wherein an opening for absorbing pressure waves of the thermal energy is formed corresponding to the ejecting portion. This is because the present invention is effective to perform recording with certainty and at high efficiency regardless of the type of recording head.

Provision of the recovery means and/or other auxiliary means for preliminary head operation is preferable, because those features can further stabilize the effects of the present invention. Examples of such means include capping means for the recording head (as disclosed above), cleaning means therefor, pressurizing or suction means for keeping the ink ejection outlets or orifices clean, and preliminary heating means (which may be an electrothermal transducer, an additional heating element or a combination thereof). Also, means for effecting preliminary ejection (to precede the actual recording operation) can stabilize the recording operation.

The recording head may be a single head which records using a single color ink, or may be plural heads corresponding to plural ink materials having different recording colors or densities. The present invention is effectively applied to an apparatus having at least one of a monochromatic mode (using black ink, most commonly), a multi-color mode using different color ink materials, and/or a full-color mode using a mixture of colors, which may be an integrally-formed recording unit or a combination of plural recording heads.

The ink jet recording apparatus may be used as an output terminal of an information processing apparatus such as a computer or the like, as a copying apparatus when combined with an image reader or the like, or as disclosed above, a facsimile machine having information sending and receiving functions.

The entire disclosures of U.S. Pat. Nos. 4,740,796; 4,723,129; 4,558,333; 4,463,359; 4,459,600; and 4,345,262, and those of Japanese Laid-Open Patent Application Nos. 54-56847, 59-123670, 59-138461, and 60-71260, are incorporated herein by reference.

While the invention has been described with reference to the preferred structures disclosed herein, it is not confined to the details set forth above; to the contrary, many modifications and variations thereof will be readily apparent to those skilled in the art, and this application is intended to cover all such modifications or changes as may come within the purposes of the disclosed improvements disclosed above, within the scope of the following claims.

What is claimed is:

1. An image forming apparatus comprising:

a recording section including:

a carriage for scanning an ink jet recording cartridge for performing recording, at least a part of the cartridge being removably mounted to said carriage, and scanning means for moving said carriage in a predetermined path having a waiting position wherein access to the ink jet recording cartridge is inhibited and a replacement position wherein access to at least said removably mounted part of the cartridge is facilitated; and a main control section including:

input means for inputting an image signal, processing means for processing said image signal for recording by said recording section, means for instructing said scanning means to move said carriage to the replacement position, judging means for judging whether the removably mounted part of the cartridge can be replaced in response to an instruction from said means for instructing said scanning means; and driving means for driving movement of said carriage, wherein said driving means drives movement of said carriage by moving said carriage to the replacement position in response to a judgment of said judging means indicating that the removably mounted part of the cartridge can be replaced, interrupting movement of said carriage to the replacement position in response to judgment of said judging means indicating that the removably mounted part of the carriage cannot be replaced, and moving said carriage to the replacement position in response to judgment of said judging means indicating that the removably mounted part of the cartridge can be replaced after said judging means had made the judgment indicating that the removably mounted part of the cartridge could not be replaced.

2. Apparatus according to claim 1, wherein said judging means includes a temperature detection circuit for detecting a temperature of a recording head of the cartridge, wherein the carriage is moved to the replacement position when the detected temperature is lower than a predetermined temperature.

3. Apparatus according to claim 1, wherein said means for instructing said scanning means also instructs said recording section to shift from a waiting condition to an operable condition.

4. Apparatus according to claim 1, wherein said means for instructing said scanning means also includes a circuit for generating a signal for placing said recording section into a cartridge-replacement mode.

5. Apparatus according to claim 4, further comprising a timer for counting an elapsed time after a shift to the cartridge-replacement mode, wherein said judging means provides a signal for terminating the cartridge-replacement mode when the elapsed time exceeds a predetermined time.

6. Apparatus according to claim 4, wherein said recording section performs a recovery process of the cartridge when the removably mounted part of the cartridge has been replaced and said control section provides a signal indicating termination of the cartridge-replacement mode.

7. Apparatus according to claim 6, wherein said recording section performs the recovery process only when the ink cartridge is replaced.

8. Apparatus according to claim 1, further comprising detecting means for detecting opening and closing of a cover of said recording section provided for exposing the removably mounted part of the cartridge when said carriage is in the replacement position.

9. Apparatus according to claim 8, wherein said means for instructing said scanning means also instructs said scanning means to move said carriage to the replacement position in response to a cover-open signal from said detecting means.

10. Apparatus according to claim 8, wherein said control section further includes means for terminating a cartridge-replacement mode in response to a cover-closed signal from said detecting means.

11. Apparatus according to claim 8, wherein said control section further includes means for placing said recording section in a waiting condition in response to a cover-closed signal from said detecting means.

12. Apparatus according to claim 8, wherein said control section further includes means for placing said recording section in a waiting condition in response to a cover-closed signal from said detecting means, wherein said control section places the recording section in a power saving mode when the waiting condition continues for a predetermined time.

13. Apparatus according to claim 12, wherein said control section places said recording section in the power saving mode only when said recording section is not in an error condition.

14. Apparatus according to claim 1, further comprising warning means for providing an audible or visible warning when said carriage is moved in response to said means for instructing said scanning means.

15. Apparatus according to claim 1, further comprising cartridge detection means for detecting whether the removably mounted part of the ink cartridge is installed in said carriage, and means for indicating a status of the cartridge when said cartridge detection means detects that the removably mounted part of the cartridge is not installed.

16. Apparatus according to claim 1, wherein said apparatus is constructed to be used as a facsimile apparatus.

17. Apparatus according to claim 1, wherein the cartridge includes a recording head for discharging ink by using thermal energy.

18. A cartridge replacement control method for use with an image forming apparatus comprising (1) a recording section including a carriage for scanning an ink jet recording cartridge for performing recording, at least a part of the cartridge being removably mounted to said carriage, and scanning means for moving said carriage in a predetermined path having a waiting position wherein access to the ink jet recording cartridge is inhibited and a replacement position wherein access to at least the removably mounted part of the cartridge is facilitated, and (2) a main control section including input means for inputting an image signal, and processing means for processing the image signal for recording by said recording section, said method comprising the steps of:

instructing said scanning means to move said carriage to the replacement position;

judging whether the removably mounted part of the cartridge can be replaced in response to an instruction of said instructing step;

moving said carriage to the replacement position in response to a result of said judging step indicating that the removably mounted part of the cartridge can be replaced;

interrupting movement of said carriage to the replacement position in response to a result of said judging step indicating that the removably mounted part of the cartridge cannot be replaced; and moving said carriage to the replacement position in response to a result of said judging step changing to indicate that the removably mounted part of the cartridge can be replaced after said interrupting step.

19. A method according to claim 18, further comprising the step of detecting a temperature of a recording head of the cartridge, wherein the carriage is moved to the replacement position when said detected temperature is lower than a predetermined temperature.

20. A method according to claim 18, further comprising the step of instructing said recording section to shift from a waiting condition to an operable condition.

21. A method according to claim 18, further comprising the step of generating a signal for placing said recording section into a cartridge-replacement mode.

22. A method according to claim 21, further comprising the step of counting an elapsed time after a shift to a cartridge-replacement mode, wherein a signal for terminating the cartridge-replacement mode is provided when the elapsed time exceeds a predetermined time.

23. A method according to claim 21, wherein said recording section performs a recovery process of the cartridge when the removably mounted part of the cartridge has been replaced and a signal has been provided indicating termination of the cartridge-replacement mode.

24. A method according to claim 23, wherein said recording section performs the recovery process only when the ink cartridge is replaced.

25. A method according to claim 22, further comprising the step of placing said recording section in a waiting condition in response to a cover-closed signal, wherein said control section places said recording section in a power saving mode when the waiting condition continues for a predetermined time.

26. A method according to claim 25, wherein said control section places said recording section in the power saving mode only when said recording section is not in an error condition.

27. A method according to claim 18, further comprising the step of detecting opening and closing of a cover of said recording section provided for exposing the removably mounted part of the cartridge when said carriage is in the replacement position.

28. A method according to claim 27, further comprising instructing said scanning means to move said carriage to the replacement position in response to a cover-open signal from said detecting means.

29. A method according to claim 27, wherein the cartridge-replacement mode is terminated in response to a cover-closed signal.

30. A method according to claim 29, further comprising the step of placing said recording section in a waiting condition in response to a cover-closed signal.

31. A method according to claim 18, further comprising the step of detecting whether the removably mounted part of the cartridge is installed in said carriage, wherein a status of the cartridge is indicated when a detection is made that the removably mounted part of the cartridge is not installed.

32. A method according to claim 18, further comprising the step of providing an audible or visible warning when said carriage is moving to the replacement position.

* * * * *

UNITED STATES PATENT AND TRADEMARK OFFICE

CERTIFICATE OF CORRECTION

PATENT NO. : 6,247,784 B1
DATED : June 19, 2001
INVENTOR(S) : Katsumi Obana et al.

It is certified that error appears in the above-identified patent and that said Letters Patent is hereby corrected as shown below:

Title page,
Item [56], References Cited, under "FOREIGN PATENT DOCUMENTS", change “359167266” to -- 59-167266 --, and change “5069553” to -- 5-69553 --.

Column 9,
Line 1, change “analyzes” to -- analyzed --.

Column 10,
Line 2, change “a” to -- at --.

Column 11,
Line 34, change “return the” to -- the return --.

Column 12,
Line 15, delete the first occurrence of “is”; and
Line 20, delete “10”.

Column 13,
Line 32, change “are” to -- which are --.

Column 16,
Line 17, change “a” to -- an --; and
Line 50, change “an” to -- in an --.

Column 20,
Line 43, change “the” to -- in the --.

UNITED STATES PATENT AND TRADEMARK OFFICE

CERTIFICATE OF CORRECTION

PATENT NO. : 6,247,784 B1
DATED : June 19, 2001
INVENTOR(S) : Katsumi Obana et al.

It is certified that error appears in the above-identified patent and that said Letters Patent is hereby corrected as shown below:

Column 24,
Line 52, change "claim 29," to -- claim 27, --.

Signed and Sealed this

Thirtieth Day of July, 2002

*Attest:*

*Attesting Officer*

JAMES E. ROGAN
*Director of the United States Patent and Trademark Office*